US011470928B2

(12) United States Patent
Munakata et al.

(10) Patent No.: US 11,470,928 B2
(45) **Date of Patent: *Oct. 18, 2022**

(54) SILVER JEWELRY AND METHOD FOR PRODUCING THE SAME

(71) Applicant: MISTY COLLECTION Co., LTD., Chofu (JP)

(72) Inventors: Masami Munakata, Chofu (JP); Kohtaro Munakata, Chofu (JP)

(73) Assignee: MISTY COLLECTION Co., LTD.

( * ) Notice: Subject to any disclaimer, the term of this patent is extended or adjusted under 35 U.S.C. 154(b) by 49 days.

This patent is subject to a terminal disclaimer.

(21) Appl. No.: 16/967,413

(22) PCT Filed: Jan. 31, 2020

(86) PCT No.: PCT/JP2020/003738
§ 371 (c)(1),
(2) Date: Aug. 5, 2020

(87) PCT Pub. No.: WO2020/179310
PCT Pub. Date: Sep. 10, 2020

(65) Prior Publication Data

US 2021/0112931 A1 Apr. 22, 2021

(30) Foreign Application Priority Data

Mar. 1, 2019 (JP) ..... JP2019-037168

(51) Int. Cl.
*A44C 27/00* (2006.01)
*A44C 1/00* (2006.01)
(Continued)

(52) U.S. Cl.
CPC ..... *A44C 27/003* (2013.01); *A44C 1/00* (2013.01); *A44C 5/00* (2013.01); *A44C 7/00* (2013.01);
(Continued)

(58) Field of Classification Search
CPC ..... A44C 27/003; A44C 1/00; A44C 5/00; A44C 7/00; A44C 9/00; A44C 15/005;
(Continued)

(56) References Cited

U.S. PATENT DOCUMENTS 6,139,652 A * 10/2000 Carrano ..... C22C 5/06 148/430

FOREIGN PATENT DOCUMENTS

JP H06-279961 A 10/1994
JP 3196546 U 3/2015
(Continued)

OTHER PUBLICATIONS

Nakayama Kimiaki, Feb. 4, 2016, Translated description of JP-2016020526-A (Year: 2016).*
(Continued)

*Primary Examiner* — Nicholas A Wang
*Assistant Examiner* — Maxwell Xavier Duffy
(74) *Attorney, Agent, or Firm* — Yokoi & Co., U.S.A.; Toshiyuki Yokoi

(57) ABSTRACT

Provided are a silver jewelry article formed using pure silver, which has high Vickers hardness and prohibit the occurrence of discoloration and its method. Disclosed are a silver jewelry article and its method, wherein the Vickers hardness is adjusted to 60 HV or higher, and when the height of the peak of 2θ=38°±0.2° by an XRD is designated as h1, and that of 2θ=44°±0.4° is designated as h2, h2/h1 is adjusted to 0.2 or greater.

6 Claims, 14 Drawing Sheets

(51) Int. Cl.

| | |
|---|---|
| ***A44C 5/00*** | (2006.01) |
| ***A44C 7/00*** | (2006.01) |
| ***A44C 9/00*** | (2006.01) |
| ***A44C 15/00*** | (2006.01) |
| ***A44C 25/00*** | (2006.01) |
| ***C22F 1/14*** | (2006.01) |
| ***C22C 5/06*** | (2006.01) |
| ***C21D 1/09*** | (2006.01) |

(52) U.S. Cl.
CPC ..... *A44C 9/00* (2013.01); *A44C 15/005* (2013.01); *A44C 25/001* (2013.01); *C21D 1/09* (2013.01); *C22C 5/06* (2013.01); *C22F 1/14* (2013.01)

(58) Field of Classification Search
CPC ..... A44C 25/001; A44C 25/00; C21D 1/09; C22C 5/06; C22F 1/14
See application file for complete search history.

(56) References Cited

FOREIGN PATENT DOCUMENTS

| | | | |
|---|---|---|---|
| JP | 2016020526 A | * | 2/2016 |
| JP | 6302780 B | | 3/2018 |

OTHER PUBLICATIONS

Walter Giurlania, Giovanni Zangari, Filippo Gambinossi, Maurizio Passaponti, Emanele Salvietti, Francesco Di Bendetto, Stefano Caporali, Massimo Innocenti, Electroplating for Decorative Applications: Recent Trends in Research and Development, Jul. 25, 2018, MDPI, Coatings 8 260, pp. 1-25 (Year: 2018).*
Extended European Search Report dated Feb. 2, 2021.
R Wg Wyckoff, Silver, Crystal Structures, 1963.
G. Mah, et al., Characterization of silver coatings deposited from a hollow cathode source, Journal of Vacuum Science and Technology, vol. 11, No. 4, pp. 663-665, Aug. 1974.
Hiroshi Nishizawa, et al., Effect of Se content in high-cyanide silver plating solution on {200} crystal plane orientation ratio of electrodeposited silver layer, Materials Science Forum, vols. 783-786, pp. 1458-1463, May 2014.
T. Theivasanthi, et al., Electrolytic Synthesis and Characterization of Silver Nanopowder, Nano Biomed. Eng. 4(2), pp. 58-65, 2012.

* cited by examiner

SILVER JEWELRY AND METHOD FOR PRODUCING THE SAME

TECHNICAL FIELD

The present invention relates to a silver jewelry article and a method for producing a silver jewelry article.

More particularly, the invention relates to a silver jewelry article that has high hardness despite using pure silver and a silver alloy having a purity of 99.9% by weight or higher and causes the development of metal allergy, the occurrence of discoloration, and the like to a lesser extent, and to a method for producing a silver jewelry article.

BACKGROUND ART

Conventionally, it is the mainstream practice to use SV925, which is a silver alloy having a purity of about 92.5% for silver jewelry.

Since this SV925 includes a predetermined amount of copper and the like as other metal components from the viewpoint of imparting high hardness, the other metal components have been causative of the development of metal allergy and the occurrence of discoloration when a silver jewelry article such as a piercing or a ring comes into direct contact with the skin.

Thus, for the purpose of decreasing the development of metal allergy or the like, a silver jewelry article formed from pure silver or SV999, which is a silver alloy having a purity of 99.9% by weight or higher, has been suggested.

However, pure silver and SV999 have Vickers hardness (hereinafter, may be simply referred to as HV) and mechanical strength that are insufficient for jewelry, pure silver and SV999 have a problem that not only the processability is poor but it is also difficult to maintain the shape over a long time period.

Therefore, there has been suggested a method for producing an Ag alloy having a Vickers hardness equal to or higher than a predetermined value, by incorporating a very small amount of Al into SV999 having a purity of 99.9% by weight or higher, casting the mixture to obtain a casting product, subsequently melting the casting product again, and molding the molten product (for example, Patent Document 1).

More specifically, there has been suggested a method for producing an Ag alloy having a Vickers hardness of 50 or higher, the Ag alloy being formed by coating a very small amount of Al with Ag, the method including introducing 100 parts by weight of silver (Ag) having a purity of 99.9% by weight or higher and a very small amount of aluminum (Al) into a melting furnace, casting the metals into a casting product, subsequently melting the casting product again, and molding the molten product.

CITATION LIST

Patent Document

Patent Document 1: JP 6302780 B

SUMMARY OF THE INVENTION

Problem to be Solved by the Invention

However, with regard to the silver alloy disclosed in Patent Document 1 and the like, since a very small amount of Al with respect to 100 parts by weight of Ag having a purity of 99.9% by weight or higher is coated with Ag and is cast to obtain a casting product, and then the casting product is melted again and molded, there is a problem that uniform dispersion of Al becomes difficult, the production cost increases, and it is also economically disadvantageous.

Furthermore, the Vickers hardness of the Ag alloy thus obtained is 50 HV or higher. More specifically, when the mixing amount of Al is 0.05% by weight, the Vickers hardness is about 63 HV, and even when the mixing amount of Al is 0.09% by weight, the Vickers hardness is about 83 HV. Thus, the respective Vickers hardness values are still insufficient.

Moreover, since the Ag alloy thus obtained contains Al at a content of 0.05% by weight, 0.09% by weight, or the like, there is a problem that the Ag alloy causes the development of metal allergy and the occurrence of discoloration.

Thus, the inventors of the present invention conducted a thorough investigation, and as a result, the inventors found that a silver jewelry article that acquires high Vickers hardness and causes the development metal allergy and the occurrence of discoloration to a lesser extent, is obtained by adjusting a predetermined crystal structure without substantially incorporating a metal such as Al into pure silver or a silver alloy having an ultrahigh-purity of 99.9% by weight or higher. Thus, the inventors completed the present invention.

That is, since silver jewelry is formed from pure silver or an ultrahigh-purity silver alloy, both of which have a particular crystal structure as characterized by XRD, it is an object of the present invention to provide a silver jewelry article, the Vickers hardness of which can be easily controlled, and which causes the development of metal allergy and the occurrence of discoloration to a lesser extent; and an efficient and economic method for producing such a silver jewelry article.

Means for Solving Problem

According to the present invention, there is provided a silver jewelry article formed from pure silver or a silver alloy having a purity of 99.9% by weight or higher, wherein the Vickers hardness of the silver jewelry article is adjusted to a value of 60 HV or higher, and when the height of the peak of $2\theta=38°\pm0.2°$ in an X-ray diffraction chart obtained by an XRD analysis of the silver jewelry article is designated as h1, and the height of the peak of $2\theta=44°\pm0.4°$ is designated as h2, the value of h2/h1 is adjusted to 0.2 or larger. Thus, the above-described problem can be solved.

That is, according to the silver jewelry article of the present invention, since the silver jewelry article is formed from pure silver or a silver alloy, both of which have a predetermined crystal structure, a Vickers hardness that is high for silver jewelry can be easily obtained regardless of whether there is a plating layer.

Furthermore, a silver jewelry article for which the incorporation of Al or the like is substantially unnecessary, the development of metal allergy in a user and the occurrence of discoloration are induced to a lesser extent, and the external appearance is excellent over a long time period, can be obtained.

Furthermore, on the occasion of configuring the silver jewelry article of the present invention, it is preferable that the Vickers hardness of the silver jewelry article to a value of 100 HV or higher, and when the height of the peak of $2\theta=38°\pm0.2°$ in an X-ray diffraction chart obtained by an XRD analysis of the silver jewelry is designated as h1, and the height of the peak of 2θ=44°±0.4° is designated as h2, the value of h2/h1 is adjusted to 1.0 or higher.

By configuring the silver jewelry article as such, for example, in a case in which the silver jewelry article is derived from a pressing-treated and further plating-treated silver base metal and has been subjected to a predetermined barrel treatment or the like, the silver jewelry article can have very high Vickers hardness.

Therefore, the silver jewelry article thus obtained can be suitably used, and while the development of metal allergy in a user and the occurrence of discoloration are suppressed, the external appearance of the silver jewelry can be maintained over a longer time period.

Furthermore, on the occasion of configuring the silver jewelry article of the present invention, it is preferable that a silver-plating layer formed from pure silver or a silver alloy having a purity of 99.9% by weight or higher is provided on the silver jewelry article.

By configuring the silver jewelry article as such, in a silver jewelry article having a silver-plating layer, the crystal structure of the silver-plating layer is mainly changed, and even higher Vickers hardness can be obtained.

Furthermore, since silver plating penetrates into the surface unevenness on the surface of the silver jewelry article, when surface polishing is performed thereafter, a silver jewelry article having even higher glossiness and smoothness can be obtained.

Furthermore, on the occasion of configuring the silver jewelry article of the present invention, when the Vickers hardness of the silver jewelry article is designated as HV, and the half-value width of the peak of 2θ=44°±0.4° in an X-ray diffraction chart obtained by an XRD analysis of the silver jewelry article is designated as W2, it is preferable that the value of HV×W2 is adjusted to a value of 18 or greater.

By configuring the silver jewelry article as such, the crystal structure of the silver jewelry article becomes more suitable, and the Vickers hardness of the silver jewelry article can be controlled more easily and accurately.

Furthermore, on the occasion of configuring the silver jewelry article of the present invention, when the Vickers hardness of the silver jewelry article is designated as HV, the half-value width of the peak of 2θ=38°±0.2° in an X-ray diffraction chart obtained by an XRD analysis of the silver jewelry article is designated as W1, and the half-value width of the peak of 2θ=44°±0.4° is designated as W2, it is preferable that the value of HV×(W1/W2) is adjusted to 48 or greater.

By configuring the silver jewelry article as such, the crystal structure of the silver jewelry article becomes more suitable, and the Vickers hardness of the silver jewelry article can be controlled more easily and accurately.

Furthermore, on the occasion of configuring the silver jewelry article of the present invention, it is preferable that the volume resistivity is adjusted to a value of 2 μΩ·cm or less.

By configuring the silver jewelry article as such, the conductivity of the silver jewelry article after processing can be further increased, and satisfactory antistatic properties can be exhibited.

Furthermore, on the occasion of configuring the silver jewelry article of the present invention, it is preferable that the silver jewelry article is any one of an earring, a pendant, a piercing, a ring, a necklace, a brooch, a bracelet, a chain, and a charm.

That is, since the silver jewelry article of the present invention is a silver jewelry article having a predetermined crystal structure, hardenability of the silver jewelry article can be easily controlled, and in addition, a piercing, a ring, a necklace, or the like, in which the development of metal allergy and the occurrence of discoloration are induced to a lesser extent while excellent processability is maintained after processing, can be obtained.

Furthermore, another embodiment of the present invention is a method for producing a silver jewelry article formed from pure silver or a silver alloy having a purity of higher than 99.9% by weight, the method including the following steps (1) and (2):

(1) a step of preparing a silver jewelry article having a predetermined shape; and (2) a step of subjecting the silver jewelry article having a predetermined shape to a surface treatment with a magnetic barrel, thereby adjusting the Vickers hardness of the silver jewelry article having a predetermined shape to 60 HV or higher, and when the height of the peak of 2θ=38°±0.2° in an X-ray diffraction chart obtained by an XRD analysis of the silver jewelry article is designated as h1, and the height of the peak of 2θ=44°±0.4° is designated as h2, adjusting the value of h2/h1 to 0.2 or greater.

That is, according to the method for producing a silver jewelry article of the present invention, since the silver jewelry article is formed from pure silver or a silver alloy, both of which have a predetermined crystal structure, for example, even when the silver jewelry article is a silver jewelry article that is derived from a pressing-treated and plating-treated silver base metal and has been subjected to a predetermined barrel treatment or the like, high Vickers hardness can be easily obtained.

Then, a silver jewelry article which causes the development of metal allergy in the wearer and the occurrence of discoloration to a lesser extent and has excellent external appearance over a long time period, can be produced economically and efficiently.

MODE(S) FOR CARRYING OUT THE INVENTION

First Embodiment

Figure 1A:
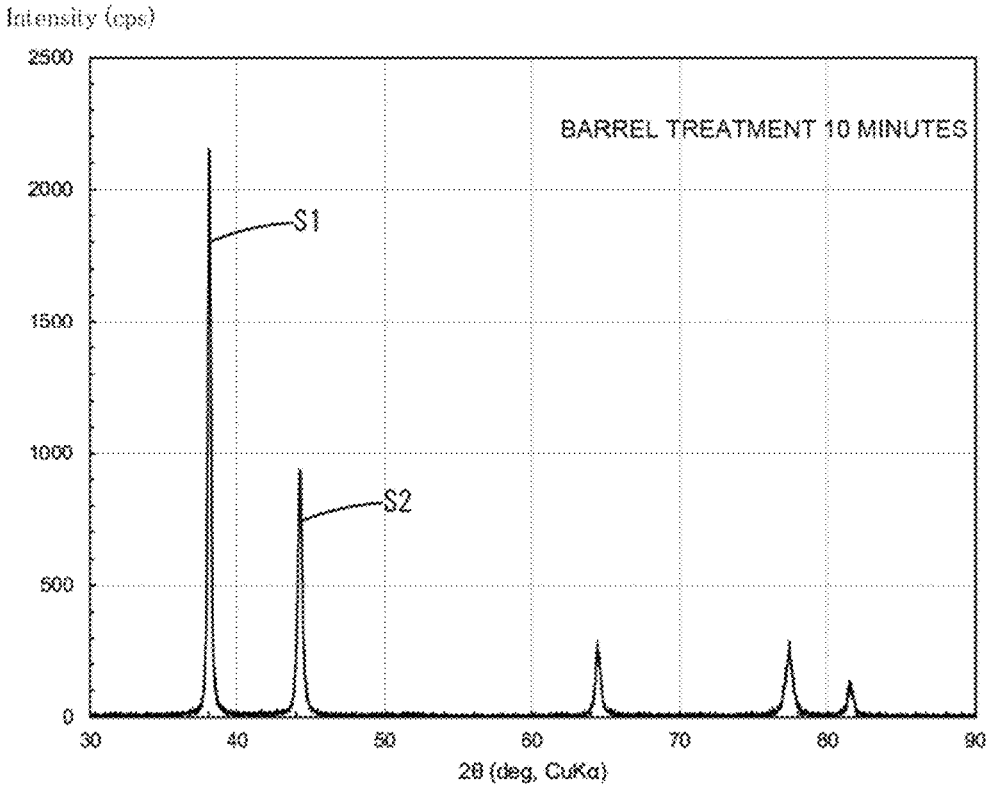
FIG. 1A is an X-ray diffraction chart obtained by an XRD analysis of a silver jewelry article (corresponding to Example 1)
Figure 1B:
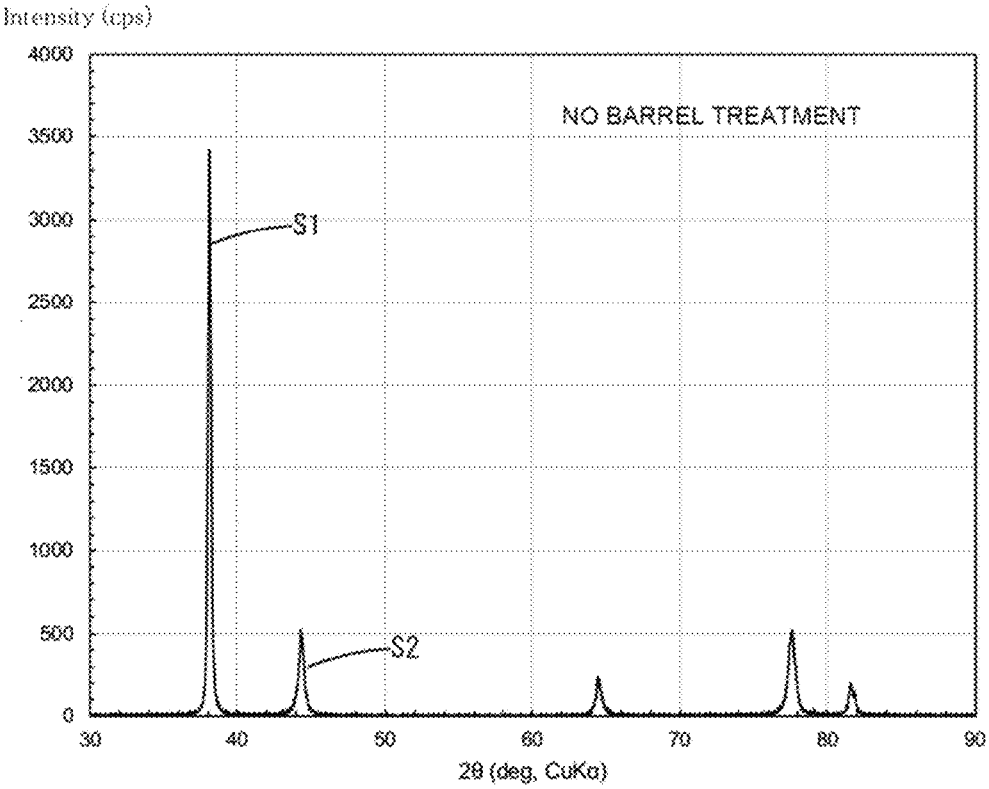
FIG. 1B is an X-ray diffraction chart obtained by an XRD analysis before a barrel treatment of a silver jewelry article (corresponding to Comparative Example 1)
Figure 2:
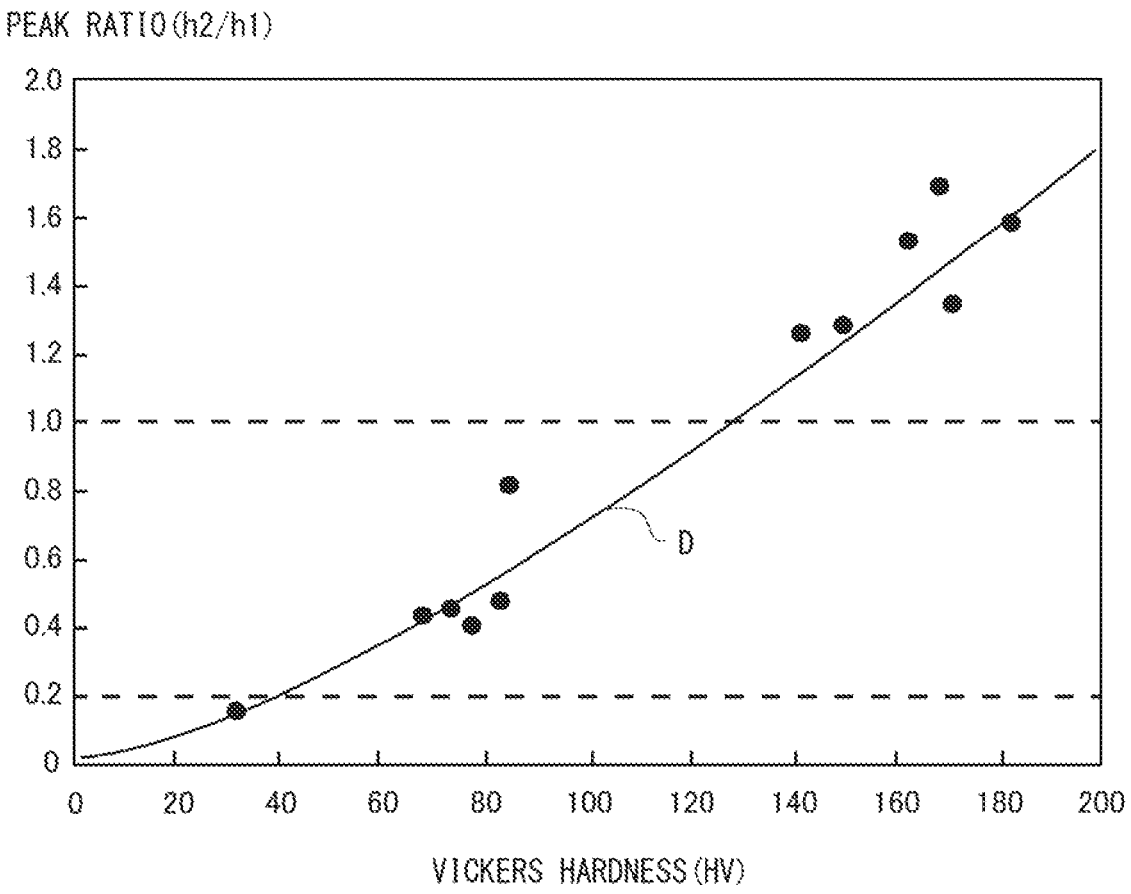
FIG. 2 is a diagram showing the relationship between the Vickers hardness (initial value) of a silver article jewelry and the ratio of (h2/h1) of the heights of predetermined peaks (h1 and h2) in an X-ray diffraction chart obtained by an XRD analysis.

A first embodiment is a silver jewelry article formed from pure silver or a silver alloy having a purity of 99.9% by weight or higher, wherein the Vickers hardness of the silver jewelry article is adjusted to 60 HV or higher, and as shown in FIGS. 1A and 1B, when the height of the peak (S1) of $2\theta=38°\pm0.2°$ in an X-ray diffraction chart obtained by an XRD analysis of the silver jewelry article is designated as h1, and the height of the peak (S2) of $2\theta=44°\pm0.4°$ is designated as h2, as shown in FIG. 2, the value of h2/h1 is adjusted to 0.2 or greater.

Meanwhile, FIG. 1A is an X-ray diffraction chart obtained by an XRD analysis based on Example 1, and FIG. 1B shows an X-ray diffraction chart obtained by an XRD analysis based on Comparative Example 1.

Furthermore, FIG. 2 is a diagram showing the relationship between the Vickers hardness (initial value) of a silver jewelry article and the ratio (h2/h1) of the heights of predetermined peaks (h1 and h2) in an X-ray diffraction chart obtained by an XRD analysis.

1. Purity

The silver jewelry article of the first embodiment is formed from pure silver or a silver alloy having a purity of 99.9% by weight or higher.

That is, since the development of metal allergy and the occurrence of discoloration are induced to a lesser extent, the silver jewelry article contains 99.9% by weight or more of silver, which means extremely high purity.

Incidentally, in the following description, pure silver implies that with regard to elements other than silver element, for example, the mass fraction measured by a glow discharge mass analyzer or the like is not above 0.001% by weight.

Therefore, the purity of silver has a value within the range of 99.9% to 100% by weight, more preferably a value within the range of 99.93% to 100% by weight, and even more preferably a value within the range of 99.98% to 100% by weight.

Meanwhile, it is preferable that in a case in which the silver jewelry article is formed from the above-mentioned silver alloy, the residual components other than silver includes gold (Au), platinum (Pt), tin (Sn), or the like.

However, conventionally, in the case of such very high-purity silver, the value of the Vickers hardness is significantly small, and there are problems such as insufficient processability and highly limited use applications. Thus, there has been no example in which such very high-purity silver was used in actual cases.

Furthermore, the purity of silver and the amount of trace components included in a silver alloy having a purity of 99.9% by weight or higher can be carried out using an element analysis method, for example, an X-ray fluorescence spectroscopy (XPS), an atomic absorption spectroscopy (AAS), or an ICP emission spectroscopy.

2. Shape

Furthermore, the shape, configuration, and the like of the silver jewelry article of the first embodiment are not particularly limited; however, for example, the silver jewelry article is preferably any one of an earring, a pendant, a piercing, a ring, a necklace, a brooch, a bracelet, a chain, and a charm.

The reason for this is because in the case of silver jewelry articles having these predetermined shapes, since they have a predetermined shape, the barrel treatment is facilitated.

Furthermore, it is because in the case of silver jewelry articles having these predetermined shapes, an effect that the development of metal allergy and the occurrence of discoloration are induced to a lesser extent can be further enjoyed.

In addition, in the case of silver jewelry articles having these predetermined shapes, hardenability can be easily controlled, and while excellent processability is maintained after processing, the development of metal allergy and the occurrence of discoloration can be further reduced.

3. Vickers Hardness (1) Initial Value

Figure 3A:
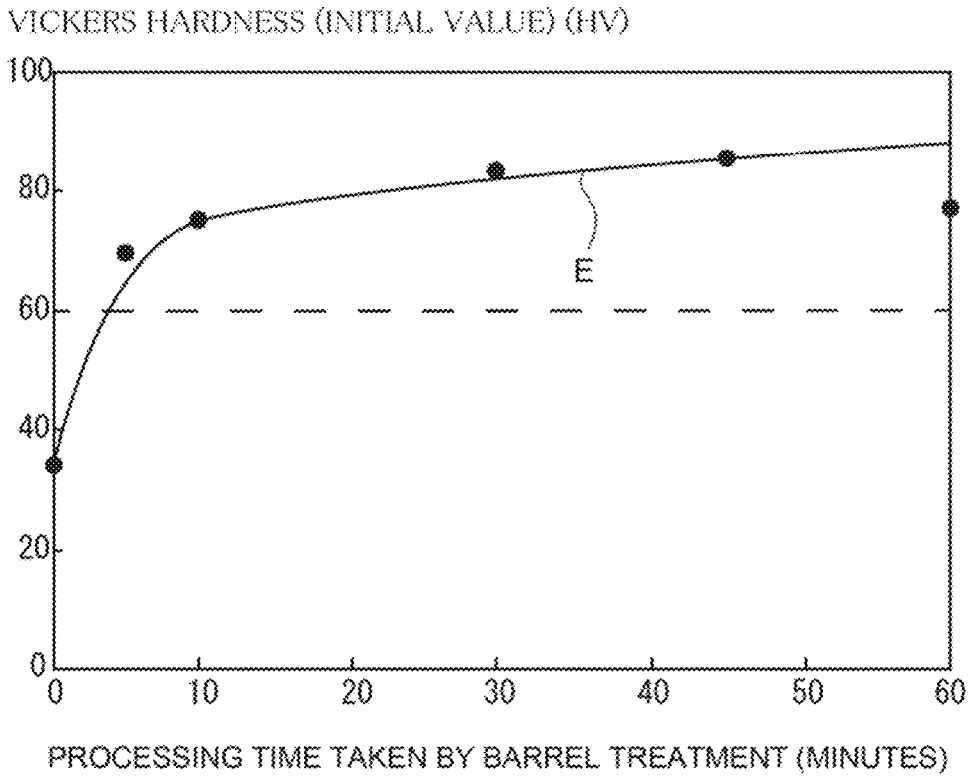
FIGS. 3A and 3B are diagrams showing the changes in the Vickers hardness (initial value) of a silver jewelry article and the changes in the Vickers hardness (after aging) of the silver jewelry article in a case in which the processing time taken by a barrel treatment for a silver jewelry article that had not been subjected to a plating treatment and a pressing treatment was changed.

Regarding the silver jewelry article of the first embodiment, as shown in FIG. 3A, the Vickers hardness (initial value) after a barrel treatment is adjusted to a value of 60 HV or higher.

The reason for this is that when the value of such Vickers hardness is below 60 HV, the silver jewelry article may be easily deformed by pressure from an external source, or the durability of the resulting jewelry article may also become insufficient.

Meanwhile, as the Vickers hardness is higher, it is preferable from the viewpoint of durability; however, in a case in which the Vickers hardness is excessively high, it may not be preferable from the viewpoint of processability.

Therefore, it is preferable that the Vickers hardness after a barrel treatment of the silver jewelry article is adjusted to a value within the range of 70 to 200 HV, and it is more preferable that such Vickers hardness is adjusted to a value within the range of 80 to 180 HV.

Here, with reference to FIG. 3A, the changes in the Vickers hardness (initial value) of a silver jewelry article in a silver jewelry article that was subjected to neither a plating treatment nor a pressing treatment in a case in which the processing time (0, 5, 10, 30, 40, or 60 minutes) by a barrel treatment for the silver jewelry article, will be explained.

More specifically, FIG. 3A employs and shows the processing time (minutes) by a barrel treatment on the axis of abscissa, and employs and shows the Vickers hardness (initial value) after a barrel treatment of a silver jewelry article that was subjected to neither a plating treatment nor a pressing treatment, on the axis of ordinate.

Then, after considering from the characteristics curve in FIG. 3A, it is understood that the processing time taken by a barrel treatment is regulated, and a suitable Vickers hardness (initial value), that is, a value of 60 HV or higher, can be obtained.

Furthermore, as will be described below, when a plating treatment is applied to a silver jewelry article that has been subjected to a barrel treatment, the Vickers hardness can be further increased.

Figure 9A:
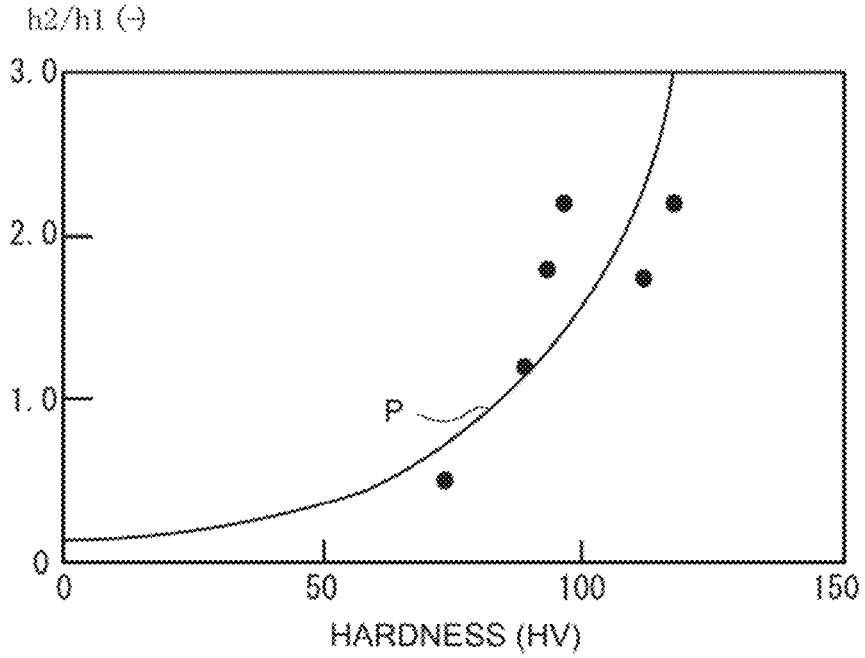
FIG. 9A is a diagram showing the relationship between the Vickers hardness (initial value) of a silver jewelry article that had been subjected to a barrel treatment and then to a plating treatment, and the ratio (h2/h1) of the heights of predetermined peaks (h1 and h2) in an X-ray diffraction chart obtained by an XRD analysis.
Figure 9B:
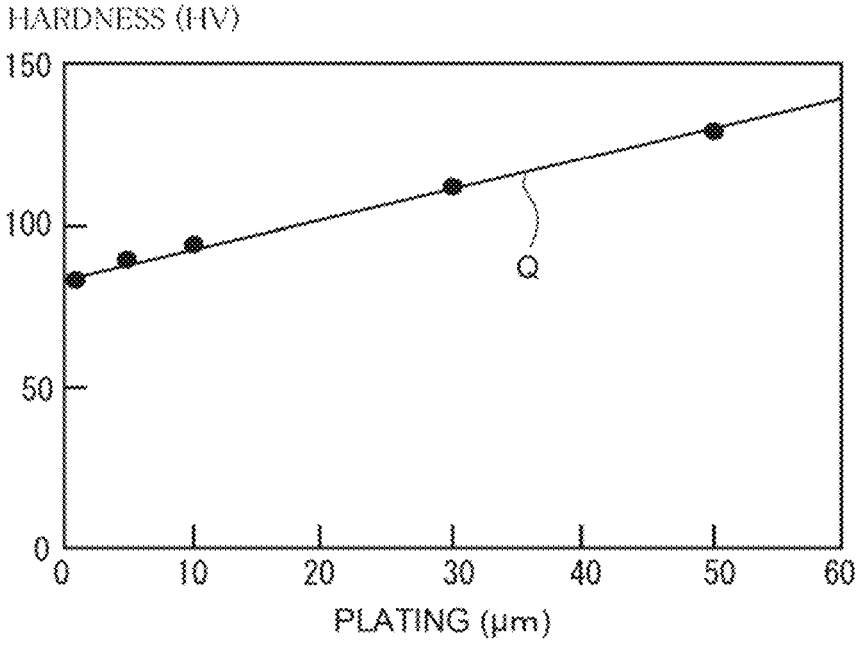
FIG. 9B is a diagram showing the relationship between the thickness of the plating treatment and the value of the Vickers hardness (initial value)

Therefore, as shown in FIG. 9B, for a silver jewelry article that has been subjected only to a barrel treatment, the Vickers hardness (initial value) per unit thickness of the plating treatment can be adjusted high to a value within the range of 0.8 to 1.2 HV. For example, it is understood that in a case in which a plating treatment with a thickness of 30 μm is applied, a value of 100 HV or higher can be obtained.

This phenomenon is speculated that as the plating undergoes crystal growth after the fashion of the surface state of the silver jewelry article that has been subjected to a barrel treatment, the crystal orientation increases, and the Vickers hardness (initial value) becomes high without applying a barrel treatment again to the plating surface.

Incidentally, as will be described below, when a silver jewelry article that has been subjected to a barrel treatment is subjected to a plating treatment and a pressing treatment, the Vickers hardness (initial value) can be adjusted to even a higher value.

Figure 4A:
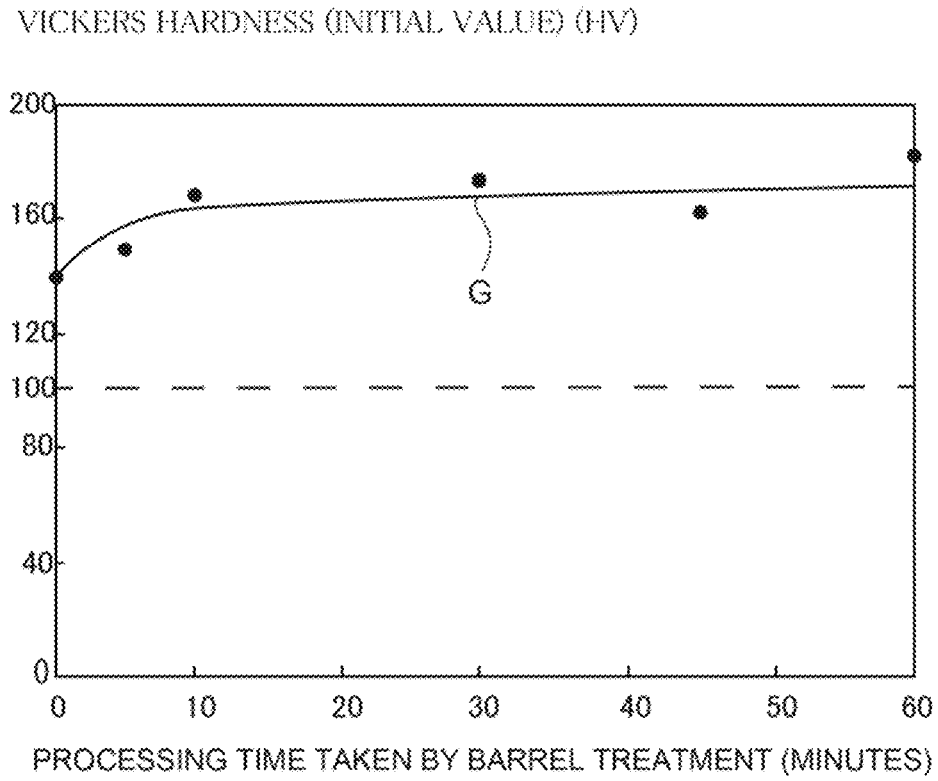
FIGS. 4A and 4B are diagrams showing the changes in the Vickers hardness (initial value) of a silver jewelry article and the changes in the Vickers hardness (after aging) of the silver jewelry article in a case in which the processing time taken by a barrel treatment for a silver jewelry article that had been subjected to a plating treatment and a pressing treatment was changed.

Therefore, as shown in FIG. 4A, from that tendency, it is understood that in the case of a silver jewelry article that has been subjected to a plating treatment and a pressing treatment, the Vickers hardness (initial value) after a barrel treatment can be adjusted to a value of 140 HV or higher. Therefore, it is more preferable that the Vickers hardness (initial value) after a barrel treatment of the silver jewelry article is adjusted to a value within the range of 150 to 200 HV, and even more preferably to a value within the range of 160 to 180 HV.

Incidentally, with regard to a silver jewelry article that has been subjected to a plating treatment or a pressing treatment, in a case in which Vickers hardness after a barrel treatment is mentioned, it means the Vickers hardness obtained in a case in which a plating treatment or a pressing treatment is carried out for the silver jewelry article that has been subjected to a barrel treatment.

(2) After Aging (80° C., 48 Hours)

Furthermore, it is preferable that after a barrel treatment, the silver jewelry article of the first embodiment is placed in an oven at 80° C. for 48 hours to be subjected to an aging treatment, and then the Vickers hardness is adjusted to a value of 60 HV or higher.

The reason for this is that by an aging treatment, a return phenomenon of the silver jewelry article occurs, and when the value of such Vickers hardness is below 60 HV, the silver jewelry article may be easily deformed by pressure from an external source, or the durability of the resulting silver jewelry article may also become insufficient.

Therefore, after a barrel treatment of the silver jewelry article, it is more preferable that the Vickers hardness after performing an aging treatment at 80° C. for 48 hours is adjusted to a value within the range of 70 to 200 HV, and it is more preferable that the Vickers hardness is adjusted to a value within the range of 80 to 180 HV.

Here, with reference to FIG. 3B, the changes in the Vickers hardness (after aging) in a silver jewelry article that has been subjected to neither a plating treatment nor a pressing treatment in a case in which the processing time (0, 5, 10, 30, 40, or 60 minutes) by a barrel treatment for the silver jewelry article was changed, will be explained.

Figure 3B:
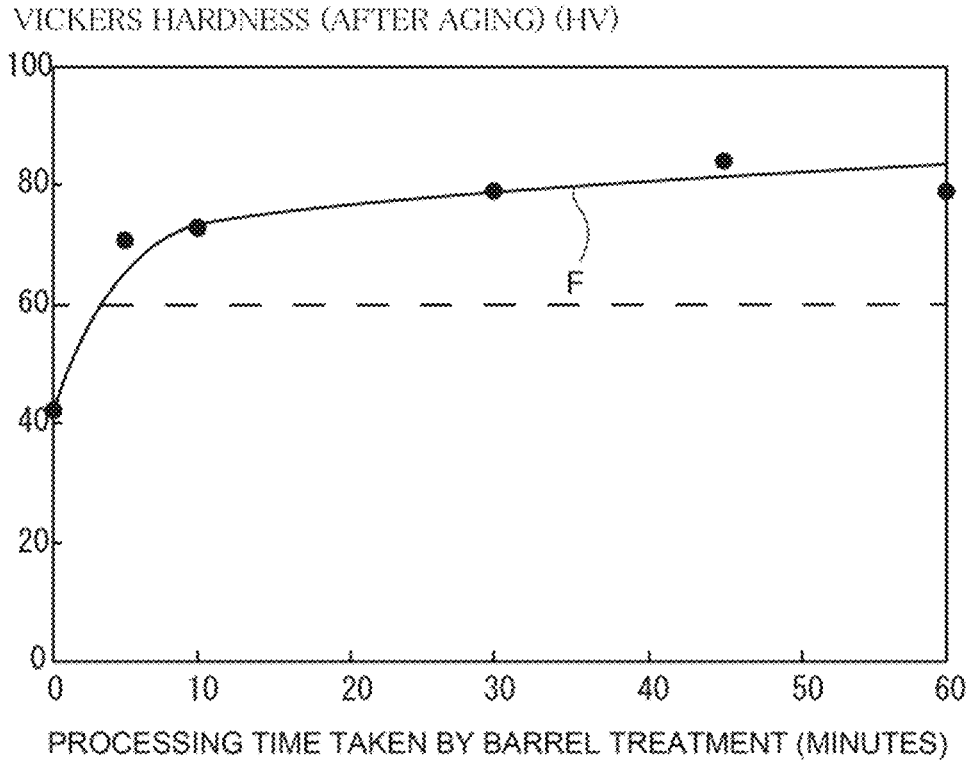

More specifically, FIG. 3B employs and shows the processing time taken by a barrel treatment on the axis of abscissa, and employs and shows the Vickers hardness (after aging) in a case in which after a barrel treatment of a silver jewelry article that had been subjected to neither a plating treatment nor a pressing treatment, the silver jewelry article was subjected to an aging treatment at 80° C. for 48 hours.

Figure 4B:
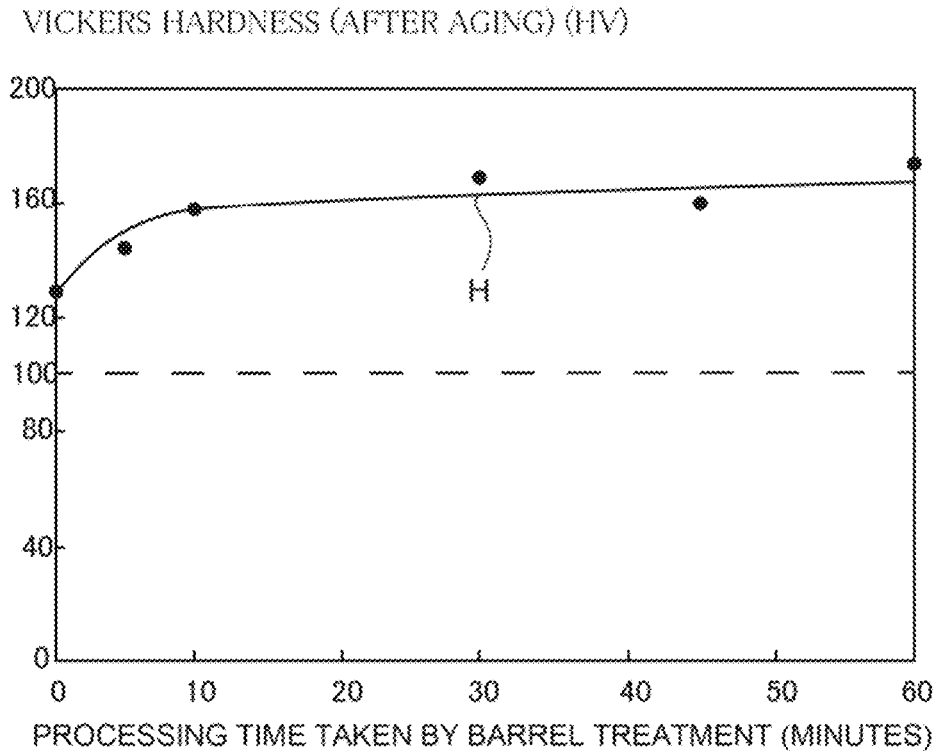

Then, after considering from the characteristics curves in FIG. 3B and FIG. 4B, it is understood that when the processing time taken by a barrel treatment is regulated, even after an aging treatment at 80° C. for 48 hours, a suitable Vickers hardness (after aging), that is, a value of at least 60 HV or higher, can be obtained.

Meanwhile, as will be described below, as shown in FIG. 4B, it has been made clear that in the case of a silver jewelry article that has been subjected to a plating treatment and a pressing treatment, after a barrel treatment, not only the initial value but also the Vickers hardness (after aging) acquire significantly high values.

Therefore, from that tendency, in the case of a silver jewelry article that has been subjected to a plating treatment and a pressing treatment, it can be said that it is more preferable that the Vickers hardness (after aging) after a barrel treatment is adjusted to a value within the range of 120 to 200 HV, and it is even more preferable that the Vickers hardness is adjusted to a value within the range of 140 to 180 HV.

(3) Annealing

Furthermore, after a barrel treatment, it is preferable that the Vickers hardness of a silver jewelry article that has been annealed by heating for 5 minutes at 100° C. is adjusted to a value of 60 HV or higher.

The reason for this is that when a silver jewelry article that has been once hardened is softened by heating, and such hardness has a value of below 60 HV, the durability of the resulting silver jewelry article may become insufficient.

That is, generally, metals have a property of becoming hard when subjected to processing (plastic deformation) such as drawing; however, metals are softened by heating, and the hardness may be decreased to the hardness value before processing.

Therefore, after a barrel treatment, it is more preferable that the Vickers hardness of a silver jewelry article that has annealed for 10 minutes at 100° C. is adjusted to a value of 60 HV or higher, and it is even more preferable that the Vickers hardness of a silver jewelry article that has been annealed for 30 minutes at 100° C. is adjusted to a value of 60 HV or higher.

Figure 13:
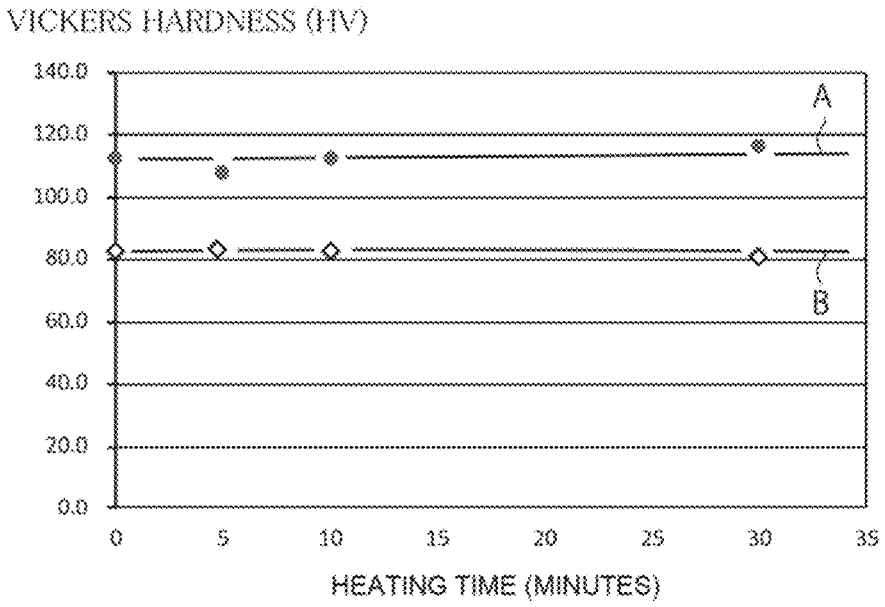
FIG. 13 is a diagram showing the changes in the Vickers hardness with respect to the time taken by heating at 100° C., for a silver jewelry article that had been subjected to a barrel treatment and a silver jewelry article that had been subjected to a plating treatment and a barrel treatment.

Here, in FIG. 13, with the annealing time at 100° C. being plotted on the axis of abscissa, and the Vickers hardness of a silver jewelry article being plotted on the axis of ordinate, the changes in the Vickers hardness obtained when a silver jewelry article (A) that had been subjected to a barrel treatment and a plating treatment and a silver jewelry article (B) that had been subjected to a barrel treatment were heated for a predetermined time at 100° C., are shown.

From these results, it is understood that even when the silver jewelry articles are heated for 30 minutes or longer at 100° C., the Vickers hardness of A and B are adjusted to a value of 60 HV or higher. Furthermore, particularly regarding A, it is understood that even when the silver jewelry article is heated for 30 minutes or longer at 100° C., the Vickers hardness can be maintained at a value of 100 HV or higher.

4. X-Ray Diffraction Chart Obtained by XRD Analysis (1) h2/h1

The silver jewelry article of the first embodiment is such that, as shown in FIGS. 1A and 1B, when the height of the peak (S1) of 2θ=38°±0.2° in an X-ray diffraction chart obtained by an XRD analysis is designated as h1, and the height of the peak (S2) of 2θ=44°±0.4° is designated as h2, as shown in FIG. 2, the value of h2/h1 is adjusted to 0.2 or greater.

The reason for this is that in a case in which the value of the ratio (h2/h1) of the heights of such peaks (h1 and h2) is adjusted to 0.2 or greater, a suitable crystal structure of the silver jewelry article can be obtained regardless of having a plating layer, and high Vickers hardness is easily obtained.

Furthermore, it is because when high Vickers hardness is obtained, it is easier to maintain the Vickers hardness for a long time period.

Therefore, it is more preferable that the value of h2/h1 is adjusted to 0.5 or greater, and even more preferably to 1.0 or greater.

Furthermore, in order to adjust the value of the ratio (h2/h1) of the heights of peaks to 1.0 or greater, it is preferable that the silver jewelry article is subjected not only to the above-mentioned barrel treatment but also to a plating treatment or a pressing treatment in advance.

As shown in FIG. 9A, with regard to a silver jewelry article that has been subjected to a barrel treatment is further subjected to a plating treatment to a thickness of 30 μm, it is preferable that when the height of the peak (S1) of 2θ=38°±0.2° in an X-ray diffraction chart obtained by an XRD analysis is designated as h1, and the height of the peak (S2) of 2θ=44°±0.4° is designated as h2, the value of h2/h1 is adjusted to 1.1 or greater.

The reason for this is that with regard to a silver jewelry article that has been subjected to a plating treatment and a pressing treatment in addition to a barrel treatment, in a case in which the value of the ratio (h2/h1) of the heights of such peaks is adjusted to below 1.1, the crystal structure of the silver jewelry article may not be made more suitable.

Therefore, it is because it may be difficult to obtain higher Vickers hardness, or it may be difficult to maintain the higher Vickers hardness for a long time period.

Therefore, it is more preferable that the value of h2/h1 is adjusted to 1.3 or greater, and it is even more preferable that the value of h2/h1 is adjusted to 1.5 or greater.

That is, as shown in the upper part of the characteristics curve of FIG. 2, when these treatments are carried out, the value of h2/h1 increases significantly, the crystal structure of the silver jewelry article becomes more suitable, and the Vickers hardness can be controlled to have an even higher value.

Therefore, with regard to a silver jewelry article that has been subjected to a barrel treatment, even in a case in which the silver jewelry article is subjected to a plating treatment to a thickness of 30 μm and then is annealed for 5 minutes at 100° C., it is preferable that the value of h2/h1 is adjusted to 1.1 or greater.

The reason for this is that similarly to the Vickers hardness, a silver jewelry article that has been once hardened is softened by heating, and the durability of the resulting silver jewelry article is prevented from becoming insufficient.

That is, it is more preferable that the value of h2/h1 of a silver jewelry article that has been annealed for 10 minutes at 100° C. after a barrel treatment is adjusted to 1.3 or greater, and it is even more preferable that the value is adjusted to 1.5 or greater.

Figure 14:
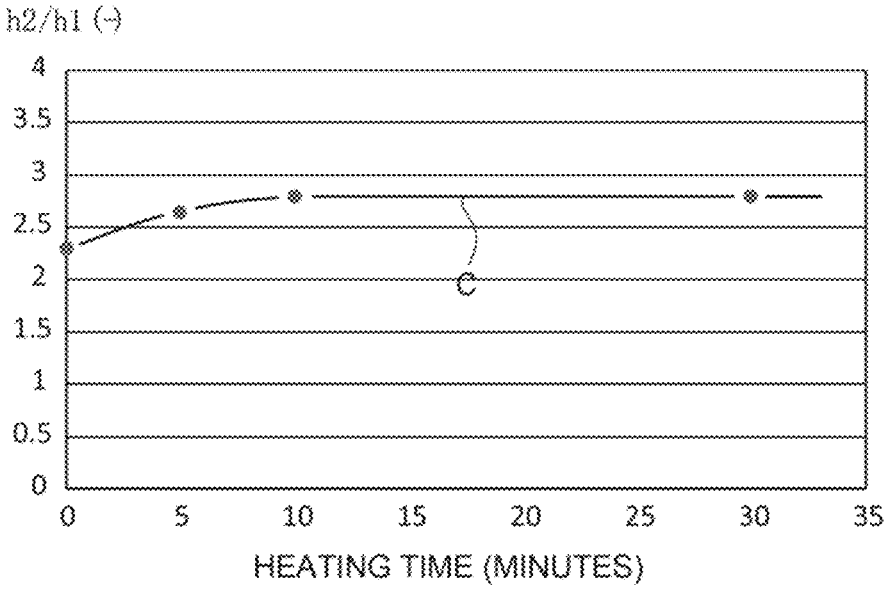
FIG. 14 is a diagram showing the changes in the ratio (h2/h1) of the heights of predetermined peaks (h1 and h2) in an X-ray diffraction chart obtained by an XRD analysis with respect to the time taken by heating at 100° C., for a silver jewelry article that had been subjected to a plating treatment and a barrel treatment.

Here, in FIG. 14, with the time taken by annealing at 100° C. being plotted on the axis of abscissa, and the value of h2/h1 of a silver jewelry article being plotted on the axis of ordinate, the changes in the Vickers hardness occurred when a silver jewelry article that had been subjected to a barrel treatment and a plating treatment was heated for a predetermined time at 100° C., are shown.

From these results, it can be understood that even in a case in which a silver jewelry article that has been subjected to a barrel treatment and a plating treatment is heated for 30 minutes or longer at 100° C., the value of h2/h1 can be adjusted to a value of 1.5 or greater.

(2) HV×W2

Figure 5A:
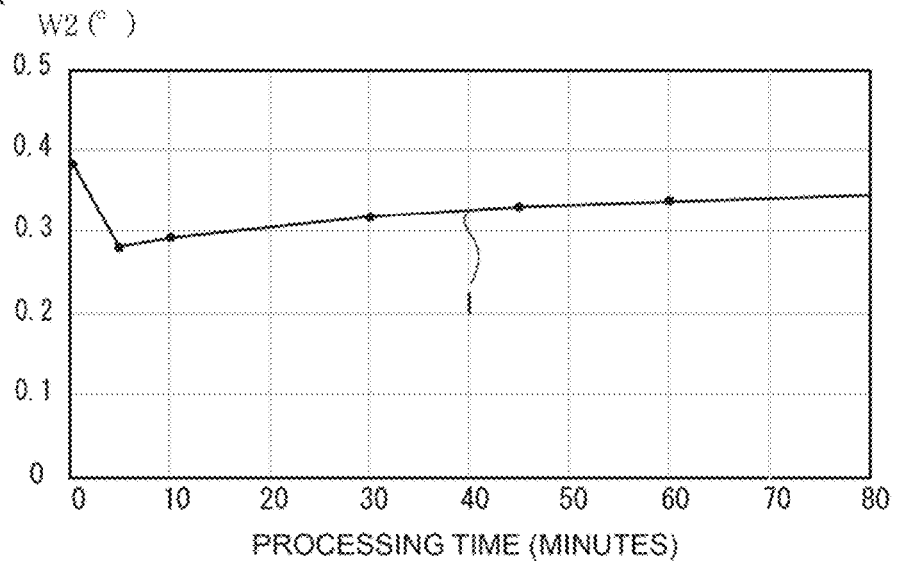
FIGS. 5A to 5C are diagrams showing the changes in the half-value widths (W1 and W2) for predetermined peaks in an X-ray diffraction chart of a silver jewelry article and the changes in the ratio thereof (W2/W1) in a case in which the processing time (0, 5, 10, 30, 45, or 60 minutes) by a barrel treatment for a silver jewelry article that had not been subjected to a plating treatment and a pressing treatment was changed.
Figure 5B:
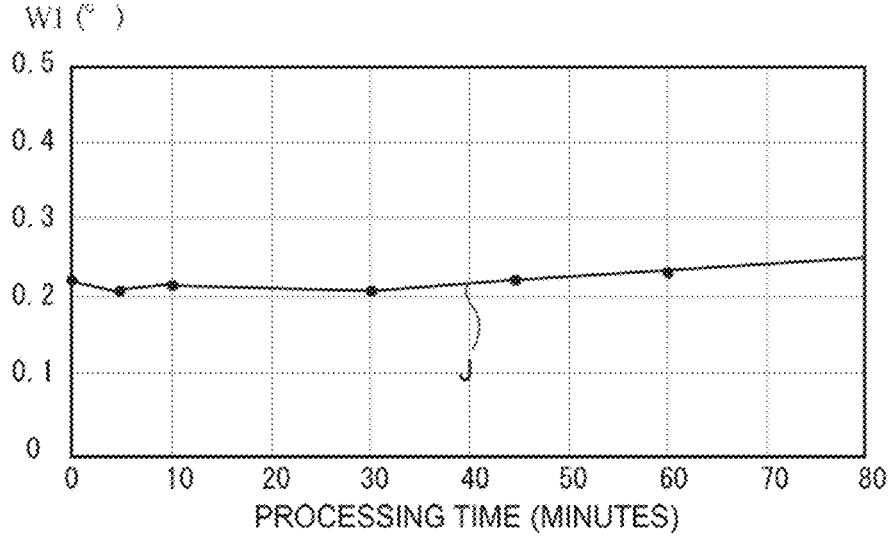
Figure 5C:
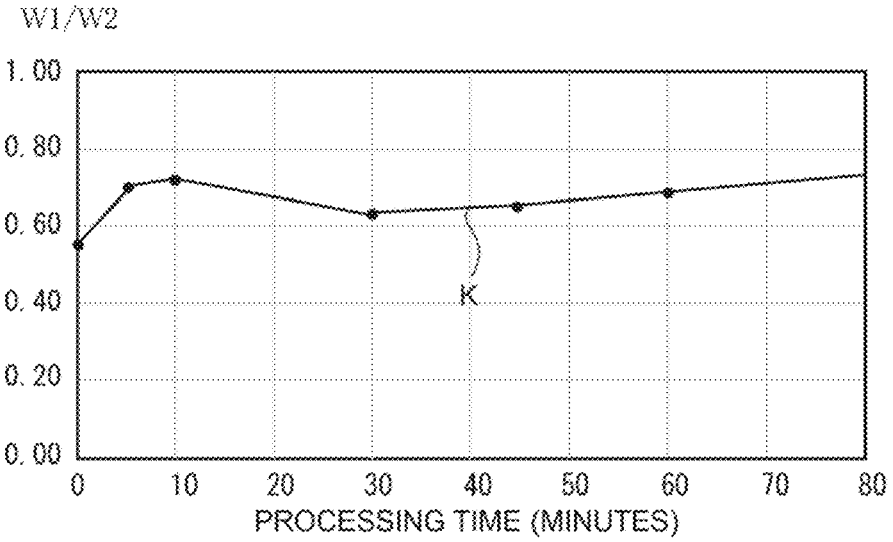
Figure 6A:
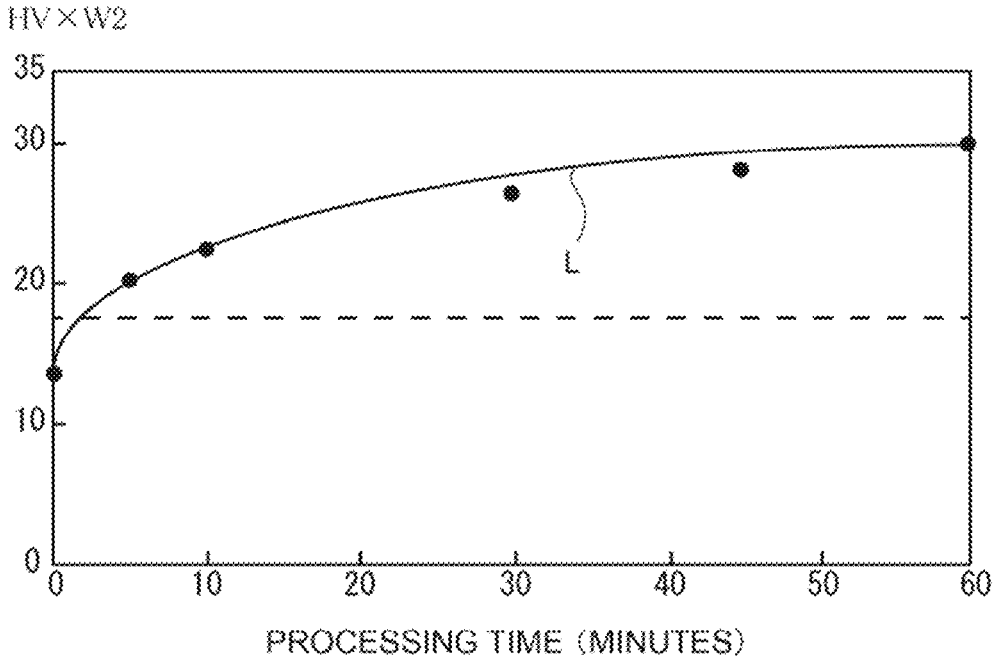
FIG. 6A is a diagram showing the changes in the value of HV×W2 in a case in which the processing time taken by a barrel treatment for a silver jewelry article that had not been subjected to a plating treatment and a pressing treatment was changed.

With regard to the silver jewelry article of the first embodiment, as shown in FIGS. 5A to 5C, when the silver jewelry article does not have a plating layer and is subjected to processing with a barrel treatment only without performing a pressing treatment, when the half-value width of the peak (S1) of 2θ=38°±0.2° in an X-ray diffraction chart obtained by an XRD analysis is designated as W1, and the half-value width of the peak (S2) of 2θ=44°±0.4° is designated as W2, as shown in FIG. 6A, in a case in which the Vickers hardness of the silver jewelry article is designated as HV, it is preferable that the value of HV×W2 is adjusted to a value of 18 or greater.

The reason for this is that in a case in which the value of such HV×W2 is adjusted to a value of 18 or greater, a more suitable crystal structure of the silver jewelry article can be obtained, and it becomes easier to obtain high Vickers hardness.

Meanwhile, FIGS. 5A to 5C are diagrams showing the relationship between the processing time taken by a barrel treatment and each of W1 and W2, obtained for a silver jewelry article that did not have a plating layer and had been subjected to processing with a barrel treatment only without performing a pressing treatment, when the half-value width of the peak (S1) of 2θ=38°±0.2° in an X-ray diffraction chart obtained by an XRD analysis was designated as W1, and the half-value width of the peak (S2) of 2θ=44°±0.4° was designated as W2.

(3) HV×(W1/W2)

Figure 6B:
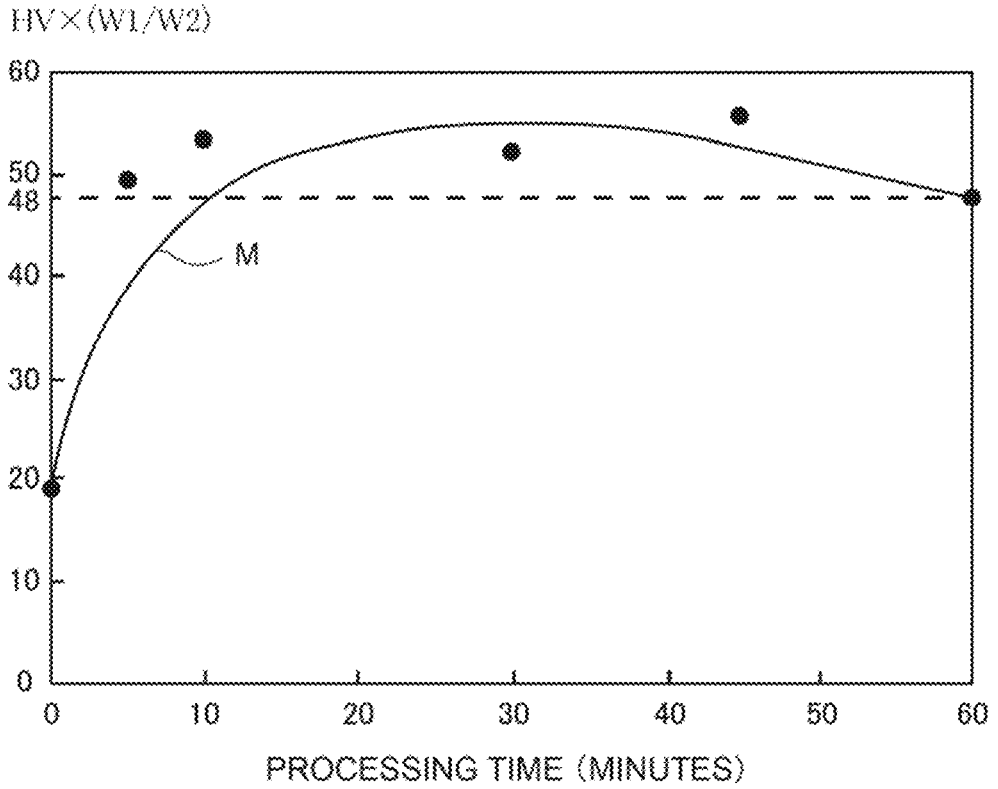
FIG. 6B is a diagram showing the changes in the value of HV×(W1/W2) in a case in which the processing time taken by a barrel treatment for a silver jewelry article that had not been subjected to a plating treatment and a pressing treatment was changed.

With regard to the silver jewelry article of the first embodiment, as shown in FIG. 6B, when the Vickers hardness of the silver jewelry article is designated as HV, the half-value width of the peak of 2θ=38°±0.2° in an X-ray diffraction chart is designated as W1, and the half-value width of the peak of 2θ=44°±0.4° is designated as W2, when the silver jewelry article does not have a plating layer and is subjected to processing with a barrel treatment only without performing a pressing treatment, it is preferable that the value of HV×(W1/W2) is adjusted to 48 or greater.

The reason for this is that in a case in which the value of such HV×(W1/W2) is adjusted to 48 or greater, a more suitable crystal structure of the silver jewelry article can be obtained, and it becomes easier to obtain high Vickers hardness.

5. Volume Resistivity

Furthermore, on the occasion of configuring the silver jewelry article of the first embodiment, it is preferable that the volume resistivity is adjusted to a value of 2 μΩ·cm or less.

Figure 7:
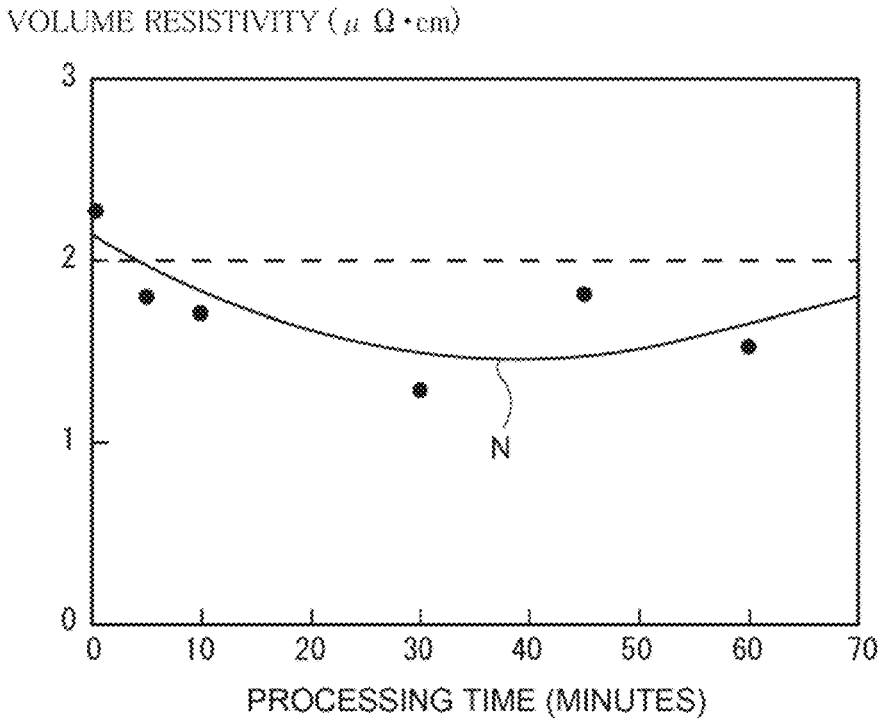
FIG. 7 is a diagram showing the changes in the volume resistivity of a silver jewelry article (linear article) in a case in which the processing time taken by a barrel treatment for a silver jewelry article that had not been subjected to a plating treatment and a pressing treatment was changed.

The reason for this is that, as shown in FIG. 7, when the volume resistivity is controlled by adjusting the barrel treatment time or the like, the electrical conductivity of the silver jewelry article after processing is improved, and the antistatic properties can be further enhanced.

Therefore, from the viewpoint that the electrical conductivity of the silver jewelry article is further improved, and the antistatic properties become satisfactory, it is more preferable that the volume resistivity of the silver jewelry article is adjusted to a value within the range of 0.001 to 1.8 μΩ·cm, and even more preferably to a value within the range of 0.01 to 1.5 μΩ·cm.

Meanwhile, the volume resistivity of a silver jewelry article can be measured by a four-terminal method of using a digital voltmeter, by changing the measurement length (for example, four points).

More specifically, a graph is obtained by plotting the resistance measured by a four-terminal method for each measurement length on the axis of ordinate and plotting the measurement length on the axis of abscissa, and the volume resistivity can be calculated from the gradient of a straight line thus obtained.

6. Plating Layer

Figure 8A:
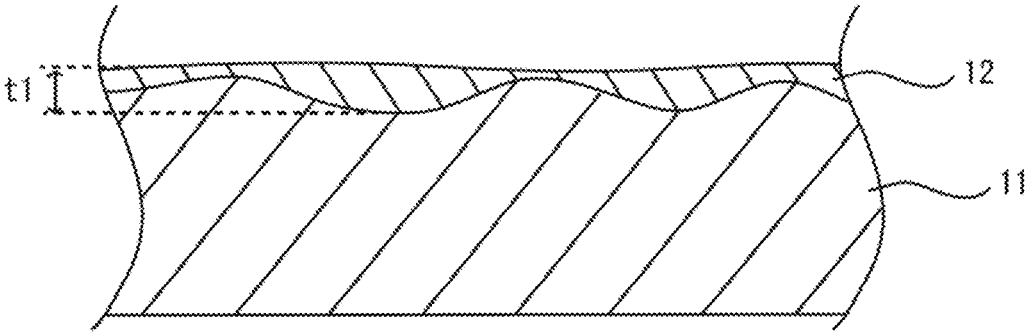
FIGS. 8A to 8C are diagrams provided in order to explain silver jewelry articles respectively having a plating layer.
Figure 8B:
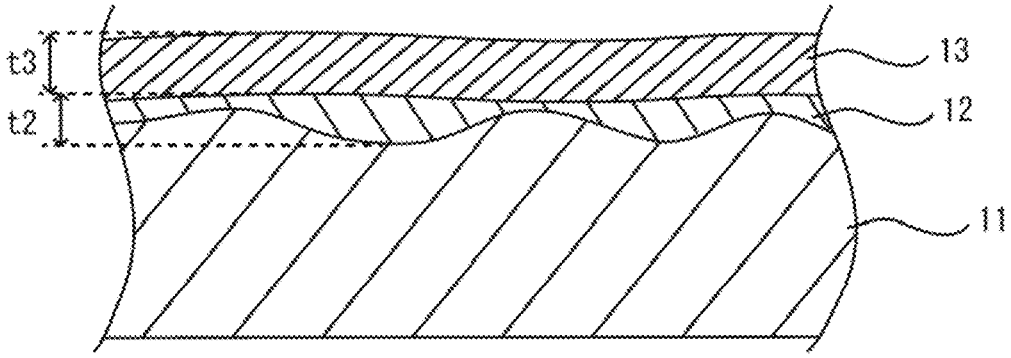
Figure 8C:
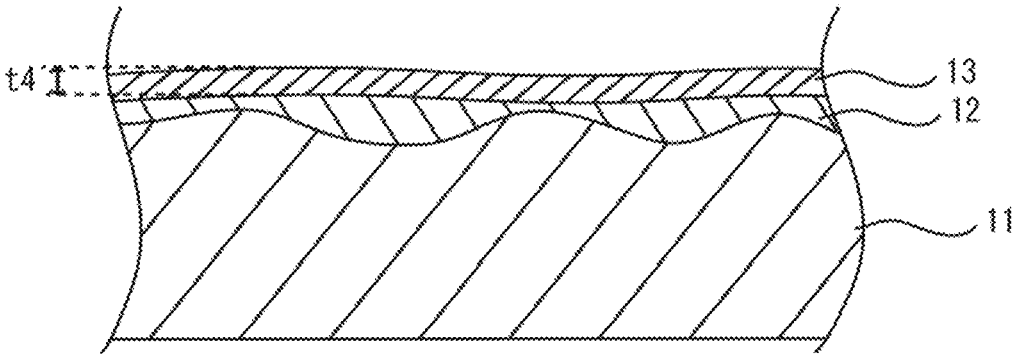

Furthermore, on the occasion of configuring the silver jewelry article, as shown in FIGS. 8A to 8C, it is preferable to form a plating layer on the surface.

The reason for this is that, as will be described in detail in a second embodiment, when plating is performed under predetermined conditions, and a plating layer having a predetermined thickness is formed, even higher Vickers hardness can be obtained for a silver jewelry article.

Furthermore, it is because since the silver plating formed by a plating treatment penetrates into the surface unevenness of the surface and thereby smoothens the surface, when the silver plating is subjected to a polishing treatment, a silver jewelry article having higher surface smoothness and glossiness can be obtained.

Therefore, the thickness of the plating layer can be determined while taking the increase in the Vickers hardness, the increase in glossiness, and the ease of a polishing treatment or the like into consideration; however, usually, it is preferable to adjust the average thickness to a value within the range of 0.01 to 100 μm.

The reason for this is that a plating layer having such a thickness can be stably formed in a short period of time by conventional electroplating or electroless plating, and an increase in the Vickers hardness, an increase in glossiness, and the ease of a polishing treatment or the like are obtained.

Therefore, in a case in which a plating layer is formed on a silver jewelry article, it is more preferable that the average thickness is adjusted to a value within the range of 0.1 to 80 and even more preferably to a value within the range of 1 to 50 μm.

Furthermore, on the occasion of forming a plating layer on the surface of the silver jewelry article, it is preferable that a surface treatment is applied to a silver jewelry article that has been subjected to a barrel treatment before a plating layer is formed, using a surface treatment agent including selenium (Se) and antimony (Sb), or any one of them (hereinafter, may be simply referred to as selenium and the like).

It is because when a surface treatment is carried out as such, selenium and the like dissolved into the plating layer, at the same time, the dissolved selenium and the like form a layer that occupies 0.001% to 0.01% by weight as a mass fraction measured by a glow discharge mass analyzer, an ICP emission spectroscopy, or the like, at a position 1 to 5 μm away from the surface.

Generally, it is known that when selenium and the like are included in a silver plating liquid, the Vickers hardness of the plating layer can be increased to a certain extent; however, higher Vickers hardness can be achieved compared to the case of mixing the same concentration of selenium and the like into the plating liquid.

It is speculated to be because when a silver jewelry article that has been subjected to a barrel treatment is subjected to the surface treatment, and a plating layer having high crystal orientation is formed, selenium and the like form a layer without being dispersed, and this is effective for increasing the Vickers hardness.

Therefore, when a surface treatment is carried out by this method, the Vickers hardness in the case of forming a plating layer can be further increased.

7. Surface Characteristics

Furthermore, on the occasion of configuring a silver jewelry article, it is preferable that the silver jewelry article has a polygonal pattern on the surface.

Figure 10A:
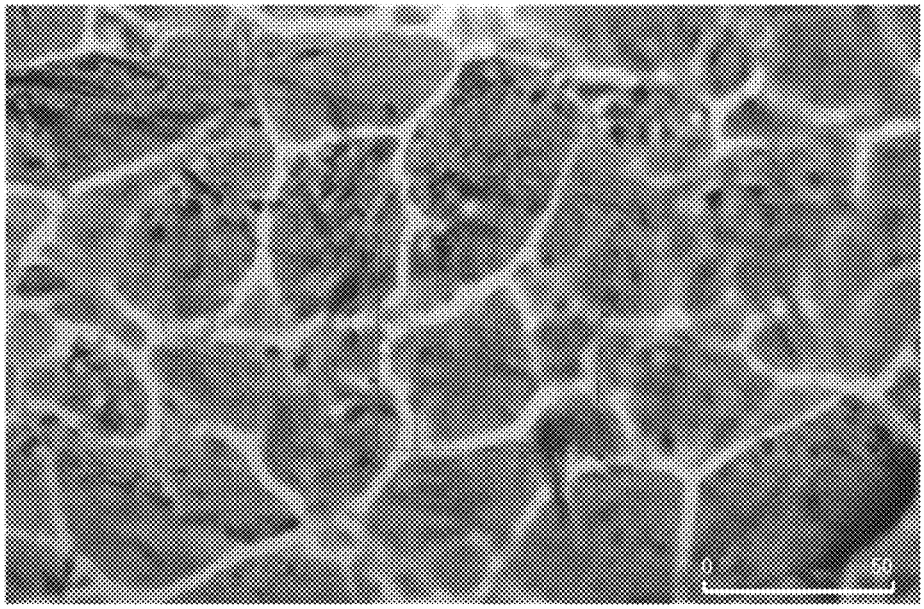
FIG. 10A is a diagram showing an example of a polygonal pattern (hexagonal pattern) recognized on the surface by a barrel treatment (corresponding to Example 1) for a silver jewelry article.
Figure 10B:
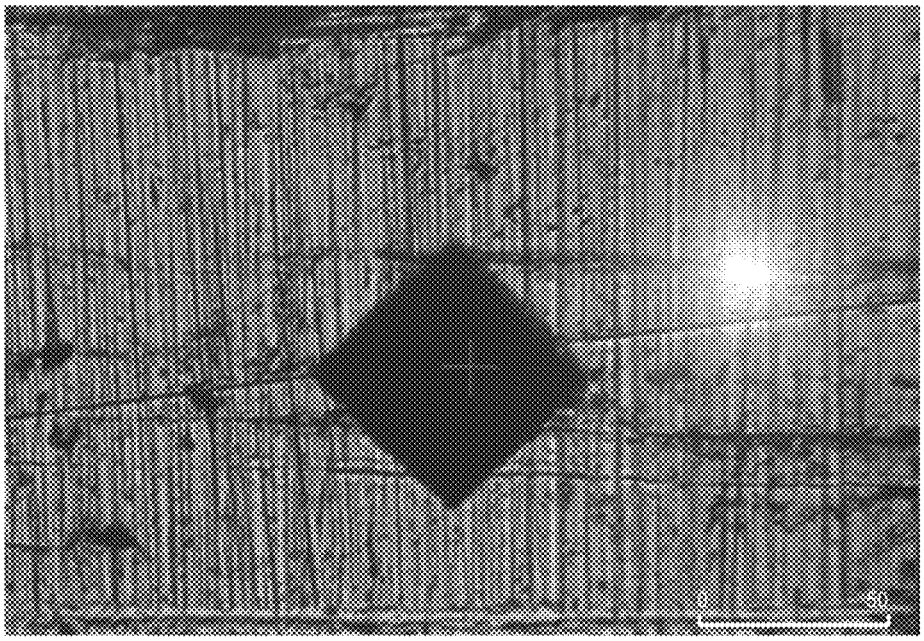
FIG. 10B is a diagram provided in order to explain the surface state before a barrel treatment (corresponding to Comparative Example 1) for a silver jewelry article.

That is, as shown in FIG. 10B, it is preferable to convert a simply smooth surface of a silver jewelry article into a surface of a silver jewelry article having a polygonal pattern (may also be referred to as hexagonal pattern).

The reason for this is that by utilizing such a polygonal pattern as a marker, the degree of barrel polishing and the Vickers hardness of the silver jewelry article after processing can be inferred, and furthermore, it can be confirmed that the Vickers hardness is in a predetermined range.

Therefore, it is because it can be visually inferred that the stability over time of a silver jewelry article after processing is reliably enhanced, while the hardenability of the silver jewelry article after processing is maintained stable.

Furthermore, whether a silver jewelry article has a polygonal pattern on the surface can be easily verified using an optical microscope.

8. Others

Conventionally, in silver jewelry articles, silver accessories such as a piercing post (foot) are fixed to the piercing main body using silver solder.

Alternatively, in silver jewelry articles, fasteners or the like at the two ends of a necklace main body, such as the fasteners of a necklace, are fixed using silver solder.

From this point of view, since the amount of use of silver solder with respect to the total amount of such a silver jewelry article is very small, it has been made clear that the development of metal allergy and the like is not comparable to the metal allergy and the like developing in the piercing itself, the necklace itself, or the like, and the development of metal allergy and the like occurs to a low extent in its own way.

However, from the viewpoint that it is more preferable that the development of metal allergy and the occurrence of discoloration are substantially not observed, it is preferable that the content of metals other than silver, for example, Ni, Cu, Zn, and Al, included in the silver solder is adjusted to 0.1 ppm or less, preferably to 0.01 ppm or less, and even more preferably 0.001 ppm or less.

In other words, in such a case, it is preferable that a needle-shaped accessory silver member 23 such as a piercing post, fasteners at two ends of a necklace main body, and the like are firmly fixed to predetermined sites by a caulking structure obtained by mechanically depressing and a laser treatment.

Figure 11A:
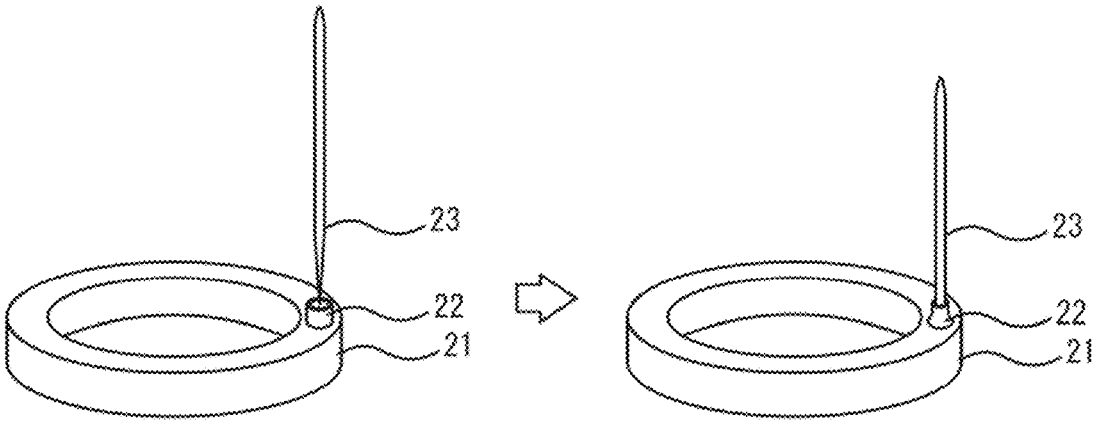
FIGS. 11A and 11B are diagrams provided in order to explain a method for producing a caulking structure.

More specifically, FIG. 11A shows parts of a production process including a caulking process.

As an example, as shown in FIG. 11A, a cylindrical hole 22 provided in the main body 21 of a silver jewelry article and a needle-shaped silver member 23 are prepared, and the tip of the needle-shaped silver member 23 is inserted into the cylindrical hole 22 provided in the main body 21.

Next, it is preferable that in a state in which the needle-shaped silver member 23 is inserted into the cylindrical hole 22 provided in the main body 21, mechanical pressure is applied from the periphery, and thereby a caulking structure is achieved.

Furthermore, instead of a needle-shaped silver member 23, it is preferable to use a nail-shaped silver member 26, in which the head portion 26*a* thereof is spread flat in a direction perpendicular to the axis by means of a pressing machine or the like and is hardened by a barrel treatment.

Figure 11B:
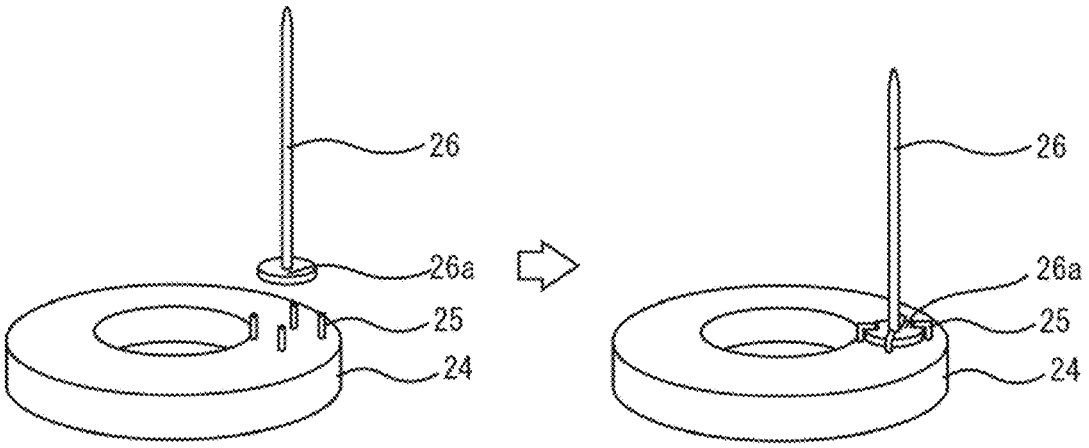

It is because with such a structure, as shown in FIG. 11B, two to eight, and preferably three to six, claws 25 are disposed in advance in a circular form on the main body 24 of a silver jewelry article so as to surround the head portion 26*a*, the claws 25 are tucked in such that the head portion 26*a* comes at the center of the circle, and thereby the head portion can be easily fixed firmly.

Moreover, with regard to a caulking structure obtained using mechanical depressing, it is also preferable that at least a portion of the fixed site is laser-welded under known conditions.

This is because when laser welding is used, the main body 21 of a silver jewelry article and a needle-shaped accessory silver member 23 can be fixed more firmly, and therefore, deformation at the peripheral site and the like can be prevented.

Second Embodiment

A second embodiment is a method for producing a silver jewelry article formed from pure silver or a silver alloy having a purity of 99.9% by weight or higher, the method including the following steps (1) and (2):

(1) a step of preparing a silver jewelry article having a predetermined shape; and (2) a step of subjecting the silver jewelry article having a predetermined shape to work hardening by performing a surface treatment with a magnetic barrel, thereby adjusting the Vickers hardness of the silver jewelry article having a predetermined shape to 60 HV or higher, and when the height of the peak of $2\theta=38°\pm0.2°$ in an X-ray diffraction chart obtained by an XRD analysis of the silver jewelry article having a predetermined shape is designated as h1, and the height of the peak of $2\theta=44°\pm0.4°$ is designated as h2, adjusting the value of h2/h1 to 0.2 or greater.

1. Step of Preparing Silver Jewelry Article Having Predetermined Shape

This is a step of preparing pure silver or a silver alloy having a purity of 99.9% by weight or higher, heating to melt the pure silver or the silver alloy, and preparing a silver jewelry article having a predetermined shape using a casting mold or the like.

Furthermore, for example, in a case in which there is an accessory such as a piercing post as in the case of a piercing, it is preferable that this accessory is bonded to the piercing main body that has been produced into a predetermined shape using a casting mold or the like, and thus a silver jewelry article having a predetermined shape is prepared.

Incidentally, as described above, it has been made clear that in the case of a silver jewelry article that has been subjected to a plating treatment and a pressing treatment, the Vickers hardness (initial value) acquires a significantly high value through a barrel treatment.

Therefore, in the case of a silver jewelry article that has a plating layer and has been subjected to a pressing treatment, since high Vickers hardness can be obtained after a barrel treatment, it is preferable to prepare such a silver jewelry article.

2. Work Hardening Step (1) Barrel Apparatus

Figure 12:
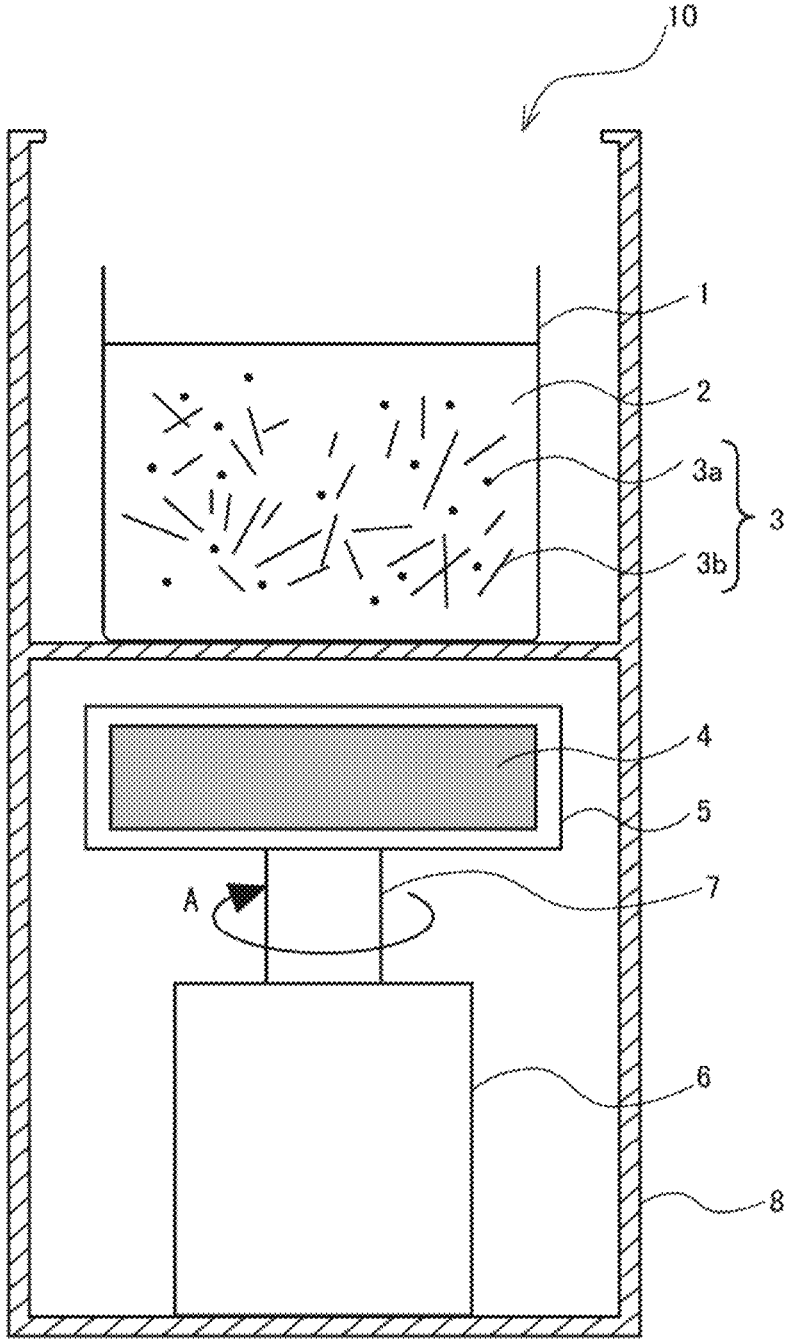
FIG. 12 is an outline diagram provided in order to explain the configuration of a barrel apparatus.

FIG. 12 shows an example of a barrel apparatus 10 for subjecting a silver jewelry article having a predetermined shape to surface polishing or the like.

That is, for example, it is preferable that the barrel apparatus 10 is composed of a barrel tank 1 storing a barrel liquid 2 that includes a silver jewelry article to be treated, barrel materials 3 (3*a*, 3*b*), a rotating magnet 4, a magnet case 5, a motor 6, a rotating shaft 7, and a jacket 8.

As indicated by arrow A in FIG. 12, the rotating shaft 7 connected to the motor 6 is rotated, and the rotating magnet 4 is also rotated along therewith. Thereby, the object to be treated (not shown in the diagram) and the barrel materials 3 (3*a*, 3*b*) in the barrel liquid 2 rotationally move while colliding with each other, and thus a barrel treatment as a surface treatment is carried out.

(2) Stirring Treatment Time

The stirring treatment time by the barrel apparatus for the silver jewelry article having a predetermined shape can be appropriately modified; however, usually, it is preferable to adjust the stirring treatment time to a value within the range of 1 to 120 minutes.

The reason for this is that when the stirring treatment time is excessively short and is below 1 minute, working hardening may not occur, and it may be difficult to obtain a desired crystal structure.

On the other hand, it is because when the stirring treatment time is excessively long and is longer than 120 minutes, the desired crystal structure that has been once formed may be changed, and again, an effect of work hardening may not be produced.

Therefore, it is more preferable that the stirring treatment time by a barrel apparatus is adjusted to a value within the range of 5 to 60 minutes, and even more preferably to a value within the range of 10 to 45 minutes.

(3) Stirring Speed

The stirring speed by a barrel apparatus for the silver jewelry article having a predetermined shape can also be appropriately modified; however, usually, it is preferable to adjust the stirring speed to a value within the range of 1 to 120 rpm in accordance with the speed of rotation.

The reason for this is that when the stirring speed is excessively short and is lower than 1 rpm, the proportion of surface collision between the silver jewelry article and the barrel materials is noticeably decreased, work hardening may not occur, and it may be difficult to obtain a desired crystal structure.

On the other hand, it is because when the stirring speed is excessively long and is higher than 120 rpm, the treatment liquid may undergo excessive foaming, or the desired crystal structure that has been once formed may be changed, and again, an effect of work hardening may not be produced.

Therefore, it is more preferable that the stirring speed by a barrel apparatus is adjusted to a value within the range of 10 to 80 rpm, and even more preferably to a value within the range of 20 to 60 rpm.

(4) Barrel Materials

For the surface polishing and the like for the silver jewelry article having a predetermined shape, the barrel materials (may also be referred to as media) used in the barrel apparatus can be appropriately changed; however, usually, it is preferable to use spherical objects or needle-shaped objects made of stainless steel (SUS304, 403, or the like), from the viewpoint of having less impurities and having predetermined hardness.

More specifically, as an example, usually, it is preferable to use spherical barrel materials made of stainless steel having a diameter of 0.1 to 5 mm and needle-shaped barrel materials made of stainless steel having a diameter of 0.5 to 5 mm, having a needle shape with a diameter of 0.005 to 5 mm, mixed at a weight ratio within the range of 10:90 to 90:10, and it is more preferable to use the barrel materials mixed at a weight ratio within the range of 20:80 to 80:20.

Since spherical or needle-shaped barrel materials can each easily increase the collision energy in relation to a magnetic barrel apparatus, it is preferable that the barrel materials are formed of the above-mentioned stainless steel, or a magnetized material obtained by magnetizing stainless steel.

(5) Aqueous Solution

Furthermore, on the occasion of performing a barrel treatment in the barrel apparatus, it is preferable to perform the barrel treatment in a solution state called barrel liquid.

In that case, the barrel liquid may be tap water; however, from the viewpoint of performing the processing treatment safely and reliably, it is more preferable to use distilled water.

Furthermore, for example, it is preferable that the temperature of the barrel liquid is managed to be 20° C. to 50° C. and the pH of the barrel liquid to be between 6 and 8, and it is preferable that the contents of unavoidable copper, iron, and aluminum in the barrel liquid are each adjusted to a value of 0.1 ppm or less, more preferably to a value of 0.05 ppm or less, and even more preferably to a value of 0.01 ppm or less.

3. Plating Treatment Step (1) Type

In a case in which plating is performed on the surface of a silver jewelry article having a predetermined shape, regarding the type of the plating, it is preferable that the plating contains silver as a main component; however, in addition to that, gold plating or platinum plating is also preferable.

It is because even with silver plating, gold plating, platinum plating, or the like, an increase in the Vickers hardness, an increase in glossiness, and the ease of a polishing treatment and the like can be obtained.

(2) Plating Treatment Conditions

Furthermore, regarding the plating treatment conditions, any known treatment conditions are employed, and typically, electroless plating 12, electroplating, and the like are suitable.

In the case of electroless plating, there is a problem that a relatively long time is required at the time of making a thick film of the resulting plating, and although a power supply device for forming an electric field in the plating liquid, and the like are required, a relatively dense plating layer with less fluctuation in the thickness can be obtained.

On the other hand, in the case of electroplating, since it is similar to electrodeposition coating or the like, although a power supply device for forming an electric field in the plating liquid, and the like are required, advantages that the thickness of the resulting plating can be made uniform, and plating can be attempted in a relatively short time period, can be obtained.

Therefore, regarding the plating conditions for electroplating, it is preferable that after a plating liquid is stored in a plating tank, a silver jewelry article is used as one of the electrodes, and usually, the electric current value is set within the range of 10 to 200 $mA/cm^2$, while the current application time is set within the range of 30 seconds to 30 minutes.

Furthermore, it is also preferable to perform composite plating by using electroless plating and electroplating in appropriate combination.

For example, in a first stage, as shown in FIG. 8A, it is preferable that a thin film plating layer having a thickness t1 of 1 μm or less is formed directly and partially on the surface of a silver jewelry article 11 by electroless plating 12, and the thin film plating layer is made substantially smooth.

Next, in a second stage, as shown in FIG. 8B to 8C, it is preferable to indirectly form a plating layer having a thickness t3 of above 1 μm, and more preferably 10 μm or more, on the surface of the silver jewelry article 11 by performing electroplating 13 on the electroless plating 12 that has been smoothened to thickness t2 by polishing t1 by 1% to 10%.

Then, it is preferable that by subjecting t3 to a polishing treatment by 1% to 10%, an electroplating 13 smoothened to thickness t4 is produced, and the entire surface of the silver jewelry article 11 is effectively smoothened.

4. Pressing Treatment Step

During the production process for a silver jewelry article, it is also preferable that the silver jewelry article is subjected to a pressing treatment in order to obtain a predetermined shape.

The reason for this is that when processing by a pressing treatment is carried out, force is applied even to the inside of the material of the silver jewelry article, and even higher Vickers hardness is likely to be obtained.

Furthermore, it is because in the case of performing forming by a pressing treatment, mass production is made easy, and the production cost may be reduced.

Incidentally, in a case in which a pressing treatment and a plating treatment are carried out, it is preferable to perform a pressing treatment first, and then to perform a plating treatment.

It is because even in a case in which the surface is roughened during the pressing treatment, the surface can be made smooth by the plating treatment.

(1) Pressing Treatment Conditions

Incidentally, with regard to the pressing treatment step, any known method can be used, and a roller press, a friction press, and the like can be used as appropriate.

Furthermore, during the pressing treatment step, it is preferable that the pressure to be applied as a linear pressure of a roller is adjusted to a value within the range of 2 to 100 N/cm.

The reason for this is that when such a pressure is below 2 N/cm, a hardness value suitable for a silver jewelry article may not be obtained.

On the other hand, it is because when such a pressure is above 100 N/cm, the load on the roll apparatus may become excessively high, or the resulting hardness may become uneven.

Therefore, during the pressing treatment step, it is more preferable that the pressure to be applied as a linear pressure of the roller is adjusted to a value within the range of 10 to 80 N/cm, and even more preferably to a value within the range of 20 to 50 N/cm.

EXAMPLES

Example 1

1. Step of Preparing Silver Jewelry Article Having Predetermined Shape

Silver having a purity of 100% by weight was prepared, and a step of heating the silver to melt, and preparing a silver jewelry article having a predetermined shape using a casting mold or the like was carried out.

Furthermore, for example, in a case in which there was an accessory such as a piercing post as in the case of a piercing, the accessory was bonded to a piercing main body that had been produced into a predetermined shape using a casting mold or the like, by a caulking method, thereby a silver jewelry article (piercing) having a predetermined shape was prepared, and the caulking part was subjected to a laser treatment.

2. Barrel Treatment

The outline of silver jewelry article having a predetermined shape thus prepared was subjected to a barrel treatment using a magnetic barrel apparatus, PRITIC M (manufactured by Priority Company) is shown in FIG. 8.

That is, 1,000 g of water, 100 g of silver jewelry articles (piercings) having a predetermined shape, 100 g of barrel materials formed from a magnetic material obtained by magnetizing spherical SUS (SUS304) having a diameter of 1 mm, and 1 g of a brightening agent were introduced into a stirring tank inside the barrel apparatus.

Next, the barrel apparatus was operated, and while the stirring tank was rotated in a horizontal direction and a vertical direction at a speed of rotation of 60 rpm, a barrel treatment was carried out for a barrel treatment time of 10 minutes.

3. Evaluation (1) Ratio (h2/h1) of Peak Heights (Evaluation 1)

For the silver jewelry articles having a predetermined shape obtained by the barrel treatment, an XRD analysis was carried out.

Next, the height (h1) of the peak of $2\theta=38°\pm0.2°$ and the height (h2) of the peak of $2\theta=44°\pm0.4°$ in an X-ray diffraction chart thus obtained were determined, and the ratio (h2/h1) of the peak heights was calculated.

(2) Vickers Hardness (Initial Value) (Evaluation 2)

Only the silver jewelry articles having a predetermined shape obtained by the barrel treatment were immediately taken out from the stirring tank, their surfaces were dried with dry cloth, subsequently the Vickers hardness (initial value) based on JIS B2244:2009 (hereinafter, the same) of the surface of each of the silver jewelry articles having a predetermined shape was measured at at least three points using a Vickers hardness meter, and the average value thereof was calculated.

●: 80 HV or higher

○: 70 HV or higher

Δ: 60 HV or higher

X: Lower than 60 HV (3) Vickers Hardness (after Aging) (Evaluation 3)

Among the silver jewelry articles having a predetermined shape obtained by the barrel treatment, samples for which the HV hardness had been measured were stored for 48 hours in an oven that was maintained at 80° C., and then those were taken out.

The silver jewelry articles were returned to room temperature, subsequently the Vickers hardness (after aging) of the surface of each of the silver jewelry articles having a predetermined shape was measured at at least three points using a Vickers hardness meter, and the average value thereof was calculated.

⊙: 80 HV or higher

○: 70 HV or higher

Δ: 60 HV or higher

X: Lower than 60 HV (4) HV×W2 (Evaluation 4)

For the silver jewelry articles having a predetermined shape obtained by the barrel treatment, an XRD analysis was carried out.

Next, the half-value width (W2) of the peak of $2\theta=44°\pm0.4°$ in an X-ray diffraction chart thus obtained was determined, and with the initial value of the Vickers hardness being designated as HV, the value of HV×W2 was calculated. The value was evaluated according to the following criteria.

⊙: $HV\times W2\geq30$.

○: $HV\times W2\geq25$.

Δ: $HV\times W2\geq18$.

X: $HV\times W2<18$.

(5) HV×(W1/W2) (Evaluation 5)

For the silver jewelry articles having a predetermined shape obtained by the barrel treatment, an XRD analysis was carried out.

Next, the half-value width (W1) of the peak of $2\theta=38°\pm0.2°$ in an X-ray diffraction chart thus obtained was determined, and with the initial value of the Vickers hardness being designated as HV, the value of HV×(W1/W2) was calculated. The value was evaluated according to the following criteria.

⊙: $HV\times(W1/W2)\geq60$.

○: $HV\times(W1/W2)\geq48$.

Δ: $HV\times(W1/W2)\geq40$.

X: $HV\times(W1/W2)<40$.

(6) Volume Resistivity (Evaluation 6)

As a substitute for the silver jewelry article having a predetermined shape obtained by the barrel treatment, a string-shaped silver jewelry article having a diameter of 1 mm was similarly used, and a barrel treatment was carried out similarly to the conditions described above.

Then, the resistance value of each of the string-shaped silver jewelry articles obtained by the barrel treatment was measured at four points at an interval of 1 cm using a four-terminal method, and a graph was produced by plotting the length on the axis of abscissa and the resistance value on the axis of ordinate.

Next, the volume resistivity (μΩ·cm) of the silver jewelry article obtained by the barrel treatment was determined from the gradient of the characteristic straight line of the graph.

⊙: 1.5 μΩ·cm or less.

○: 1.8 μΩ·cm or less.

Δ: 2.0 μΩ·cm or less.

X: Above 2.0 μΩ·cm.

(7) Metal Allergy Characteristics (Evaluation 7)

Five test subjects (A, B, C, D, and E) having metal allergy were prepared, they were asked to wear silver jewelry articles (piercings) obtained by the barrel treatment on the ear for two days, and whether the silver jewelry articles developed metal allergy was visually inspected. Thus, the metal allergy characteristics were evaluated according to the following criteria.

⊙: Development of metal allergy was not observed in the five persons.

○: Development of metal allergy was observed in one person among the five persons.

Δ: Development of metal allergy was observed in two persons among the five persons.

X: Development of metal allergy was observed in three to five persons among the five persons.

(8) Discoloration Characteristics (Evaluation 8)

The silver jewelry articles thus obtained were immersed in 200 g of hydrogen sulfide water stored in a 500-liter vessel for 168 hours.

Next, discoloration occurred in the silver jewelry articles in the 500-liter vessel was evaluated according to the following criteria.

⊙: There was no noticeable discoloration even after a lapse of 168 hours.

○: Slight discoloration was observed after a lapse of 168 hours.

Δ: Noticeable discoloration was observed after a lapse of 168 hours.

X: Noticeable discoloration was observed in a time below 168 hours.

Example 2

In Example 2, silver jewelry articles were obtained in the same manner as in Example 1, except that the barrel treatment time was lengthened to 30 minutes, and the Vickers hardness and the like were evaluated.

Example 3

In Example 3, silver jewelry articles were obtained in the same manner as in Example 1, except that the barrel treatment time was further lengthened to 45 minutes, and the Vickers hardness and the like were evaluated.

Example 4

In Example 4, silver jewelry articles were obtained in the same manner as in Example 1, except that the barrel treatment time was further lengthened to 60 minutes, and the Vickers hardness and the like were evaluated.

Example 5

In Example 5, silver jewelry articles were obtained in the same manner as in Example 1, except that the barrel treatment time was shortened to 5 minutes, and the Vickers hardness and the like were evaluated.

Example 6

In Example 6, silver jewelry articles were obtained in the same manner as in Example 1, except that electroplating was performed to obtain a thickness of 20 μm on the surface of the silver jewelry articles of Example 1, and the electroplating was subjected to a polishing treatment to smoothen the surface, and the Vickers hardness and the like were evaluated.

Example 7

In Example 7, silver jewelry articles were obtained in the same manner as in Example 1, except that electroplating was performed to obtain a thickness of 30 μm on the surface of the silver jewelry articles of Example 1, and then the electroplating was subjected to a barrel polishing treatment for 30 minutes, and the Vickers hardness and the like were evaluated.

Example 8

In Example 8, silver jewelry articles were obtained in the same manner as in Example 1, except that electroplating was performed to obtain a thickness of 10 μm on the surface of the silver jewelry articles of Example 1, and then the electroplating was subjected to a barrel polishing treatment for 45 minutes, and the Vickers hardness and the like were evaluated.

Examples 9 to 16

In Examples 9 to 16, silver jewelry articles were obtained in the same manner as in Examples 1 to 8, except that the base metals for the silver jewelry articles of Examples 1 to 8 were each subjected to a pressing treatment before a barrel treatment and the like, using a metal press roll apparatus under the conditions of a linear pressure of 50 N/cm, and the Vickers hardness and the like were evaluated.

As a result, it was verified that for each of the base metals, high Vickers hardness of 100 HV or higher was obtained while satisfactory results were maintained for the metal allergy characteristics.

Comparative Example 1

In Comparative Example 1, silver jewelry articles were obtained in the same manner as in Example 1, except that a barrel treatment was not carried out, and the Vickers hardness and the like were evaluated.

Comparative Example 2

In Comparative Example 2, silver jewelry articles were obtained in the same manner as in Comparative Example 1, except that electroplating was performed to obtain a thickness of 20 μm, and the Vickers hardness and the like were evaluated.

TABLE 1

| | Barrel time (min) | Silver plating treatment | Evaluation 1 | Evaluation 2 | Evaluation 3 | Evaluation 4 | Evaluation 5 | Evaluation 6 | Evaluation 7 | Evaluation 8 |
|---|---|---|---|---|---|---|---|---|---|---|
| Example 1 | 10 | None | 0.44 | ○ | Δ | Δ | ○ | ○ | ⊙ | ⊙ |
| Example 2 | 5 | None | 0.42 | Δ | Δ | Δ | ○ | ○ | ⊙ | ⊙ |
| Example 3 | 30 | None | 0.39 | ⊙ | ⊙ | ○ | ○ | ⊙ | ⊙ | ⊙ |
| Example 4 | 45 | None | 0.81 | ⊙ | ⊙ | ○ | ○ | ○ | ⊙ | ⊙ |
| Example 5 | 60 | None | 0.43 | ○ | ○ | ⊙ | ○ | ○ | ⊙ | ⊙ |
| Example 6 | 10 | Applied 20 μm | 0.63 | ⊙ | ⊙ | ○ | ○ | ⊙ | ⊙ | ⊙ |
| Example 7 | 30 | Applied 30 μm | 0.72 | ⊙ | ⊙ | ○ | ⊙ | ⊙ | ⊙ | ⊙ |
| Example 8 | 45 | Applied 10 μm | 0.75 | ⊙ | ⊙ | ⊙ | ⊙ | ⊙ | ⊙ | ⊙ |
| Comparative Example 1 | 0 | None | 0.18 | X | X | X | X | X | ⊙ | ○ |
| Comparative Example 2 | 0 | Applied 20 μm | 0.19 | Δ | Δ | X | ○ | X | ⊙ | ○ |

Evaluation 1: h2/h1
Evaluation 2: Vickers hardness (initial value)
Evaluation 3: Vickers hardness (after aging)
Evaluation 4: HV × W2
Evaluation 5: HV(W1/W2)
Evaluation 6: Volume resistivity
Evaluation 7: Metal allergy characteristics
Evaluation 8: Discoloration characteristics

TABLE 2

| | Barrel time (min) | Silver plating treatment | Evaluation 1 | Evaluation 2 | Evaluation 3 | Evaluation 4 | Evaluation 5 | Evaluation 6 | Evaluation 7 | Evaluation 8 |
|---|---|---|---|---|---|---|---|---|---|---|
| Example 9 | 10 | None | 0.83 | ⊙ | ⊙ | ⊙ | ○ | ○ | ⊙ | ⊙ |
| Example 10 | 5 | None | 0.81 | ⊙ | ⊙ | ⊙ | ○ | ○ | ⊙ | ⊙ |
| Example 11 | 30 | None | 0.95 | ⊙ | ⊙ | ⊙ | ⊙ | ⊙ | ⊙ | ⊙ |
| Example 12 | 45 | None | 0.91 | ⊙ | ⊙ | ⊙ | ⊙ | ⊙ | ⊙ | ⊙ |
| Example 13 | 60 | None | 1.02 | ⊙ | ⊙ | ⊙ | ⊙ | ○ | ⊙ | ⊙ |
| Example 14 | 10 | Applied 20 μm | 1.35 | ⊙ | ⊙ | ⊙ | ⊙ | ⊙ | ⊙ | ⊙ |
| Example 15 | 30 | Applied 30 μm | 1.42 | ⊙ | ⊙ | ⊙ | ⊙ | ⊙ | ⊙ | ⊙ |
| Example 16 | 45 | Applied 10 μm | 1.56 | ⊙ | ⊙ | ⊙ | ⊙ | ⊙ | ⊙ | ⊙ |

Evaluation 1: h2/h1
Evaluation 2: Vickers hardness (initial value)
Evaluation 3: Vickers hardness (after aging)
Evaluation 4: HV × W2
Evaluation 5: HV(W1/W2)
Evaluation 6: Volume resistivity
Evaluation 7: Metal allergy characteristics
Evaluation 8: Discoloration characteristics

INDUSTRIAL APPLICABILITY

According to the silver jewelry article and the method for producing a silver jewelry article of the present invention, it is possible to provide a silver jewelry article in which, despite that pure silver and an ultrahigh-purity silver alloy were used, Vickers hardness (HV) equal to or higher than a predetermined level compared to pure silver is exhibited by carrying out a barrel treatment and the like, and the development of metal allergy and the occurrence of discoloration are induced to a lesser extent; and to provide a method for producing the silver jewelry article.

Furthermore, by subjecting a silver jewelry article obtained using pure silver and an ultrahigh-purity silver alloy, to a predetermined barrel treatment and then a plating treatment with pure silver, it is possible to provide a silver jewelry article in which even higher Vickers hardness (HV) than a predetermined level is exhibited, and the development of metal allergy and the occurrence of discoloration are induced to a lesser extent; and to provide a method for producing the silver jewelry article.

Moreover, when a silver jewelry article derived from a silver jewelry article that has been subjected to a predetermined barrel treatment is subjected to a pressing treatment and then to a plating treatment, very high Vickers hardness can be obtained.

Therefore, even a person having allergic dermatitis originating from metal allergy can use the silver jewelry article safely and hygienically, and it is expected to provide silver jewelry articles that can be used with a wide selection of shapes, more economically efficiently.

Furthermore, according to the silver jewelry articles and the method for producing a silver jewelry article of the present invention, even if plastic deformation of silver occurred significantly, and the silver jewelry article was subjected to aging or annealing under predetermined conditions (80° C., 48 hours), a phenomenon in which the crystal structure returns to the original structure, and thereby the Vickers hardness is decreased, was not observed in particular.

In addition, it was found that the volume resistivity of pure silver can be adjusted to a predetermined value or lower by performing a barrel treatment and the like.

Therefore, the silver itself that constitutes the silver jewelry article derived from the present invention, is expected to be used also for use applications related to electrically conductive materials with lower heat generation characteristics.

The invention claimed is:

1. A silver jewelry article formed from pure silver or a silver alloy having a purity of 99.9% by weight or higher, wherein a content of aluminum is less than 0.05% by weight in the silver jewelry article, and the silver jewelry article includes configurations of (1) to (4):

(1) the silver jewelry article is any one of an earring, a pendant, a piercing, a ring, a necklace, a brooch, a bracelet, a chain, and a charm;

(2) a Vickers hardness of the silver jewelry article is within a range of 80 to 200 HV;

(3) when a height of a peak of $2\theta=38°\pm0.2°$ in an X-ray diffraction chart obtained by an XRD analysis of the silver jewelry article is designated as h1, and a height of a peak of $2\theta=44°\pm0.4°$ is designated as h2, a value of h2/h1 is adjusted to 0.5 or greater; and (4) when the Vickers hardness of the silver jewelry article is designated as HV and a half-value width of the peak of $2\theta=44°\pm0.4°$ obtained by an XRD analysis of the silver jewelry article is designated as W2, a value of HV×W2 is 25 or greater.

2. The silver jewelry article according to claim 1, wherein the Vickers hardness of the silver jewelry article is adjusted to 100 to 200 HV, and when the height of the peak of $2\theta=38°\pm0.2°$ in an X-ray diffraction chart obtained by an XRD analysis of the silver jewelry article is designated as h1, and the height of the peak of $2\theta=44°\pm0.4°$ is designated as h2, the value of h2/h1 is adjusted to 1.0 or greater.

3. The silver jewelry article according to claim 1, further comprising a silver plating formed from pure silver or a silver alloy having a purity of 99.9% by weight or higher on the silver jewelry article.

4. The silver jewelry article according to claim 1, wherein when a half-value width of the peak of $2\theta=38°\pm0.2°$ in an X-ray diffraction chart obtained by the XRD analysis of the silver jewelry article is designated as W1, a value of HV×(W1/W2) is adjusted to 48 or greater.

5. The silver jewelry article according to claim 1, wherein a volume resistivity is 2 μΩ·cm or less.

6. The silver jewelry article according to claim 1, wherein the Vickers hardness of the silver jewelry article that has annealed for 10 to 30 minutes at 100° C. is 80 to 200 HV.

* * * * *